US011982040B2

(12) United States Patent
Cho et al.

(10) Patent No.: US 11,982,040 B2
(45) Date of Patent: May 14, 2024

(54) LAUNDRY TREATING APPARATUS AND ASSEMBLY METHOD OF THE SAME

(71) Applicant: LG Electronics Inc., Seoul (KR)

(72) Inventors: Sangho Cho, Seoul (KR); Donghyun Jin, Seoul (KR); Youngho Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 298 days.

(21) Appl. No.: 17/193,701

(22) Filed: Mar. 5, 2021

(65) Prior Publication Data

US 2021/0277581 A1 Sep. 9, 2021

(30) Foreign Application Priority Data

Mar. 6, 2020 (KR) ..... 10-2020-0028407

(51) Int. Cl.

*D06F 29/00* (2006.01)
*D06F 34/34* (2020.01)
*D06F 39/12* (2006.01)

(52) U.S. Cl.

CPC ..... *D06F 39/125* (2013.01); *D06F 29/005* (2013.01); *D06F 34/34* (2020.02)

(58) Field of Classification Search

CPC ..... D06F 29/00; D06F 29/005; D06F 29/02; D06F 34/34; D06F 39/125

See application file for complete search history.

(56) References Cited

U.S. PATENT DOCUMENTS 5,926,886 A * 7/1999 Braunschweig ..... D06F 39/12 68/3 R
2006/0010934 A1 1/2006 Kim
2009/0025432 A1* 1/2009 Kim ..... D06F 34/34 68/12.27

(Continued)

FOREIGN PATENT DOCUMENTS

CN 105316900 2/2016
CN 106149311 11/2016
DE 9101782 U1 * 5/1999 ..... D06F 29/00

(Continued)

OTHER PUBLICATIONS

Extended European Search Report in European Appln. No. 21159858.6, dated Jul. 30, 2021, 13 pages.

(Continued)

*Primary Examiner* — Joseph L. Perrin
*Assistant Examiner* — Irina Graf
(74) *Attorney, Agent, or Firm* — Fish & Richardson P.C.

(57) ABSTRACT

An assembly method of a laundry treating apparatus includes a first step of positioning a second treating apparatus in a desired place for assembly, a second step of seating a first treating apparatus on the second treating apparatus, a third step of coupling a upper fastening unit of the second treating apparatus with a lower portion of the first treating apparatus, and a fourth step of coupling a control panel onto a panel seating portion provided between a lower surface of a first front panel of the first treating apparatus and an upper surface of the second front panel of the second treating apparatus. The upper fastening unit may be positioned to be higher than a lower surface of the first treating apparatus after the second step is performed.

3 Claims, 18 Drawing Sheets

(56) References Cited

U.S. PATENT DOCUMENTS

| | | | |
|---|---|---|---|
| 2009/0126419 | A1 | 5/2009 | Yoon et al. |
| 2009/0145176 | A1 | 6/2009 | Kim et al. |

FOREIGN PATENT DOCUMENTS

| | | | | | |
|---|---|---|---|---|---|
| DE | 102005026134 | A1 * | 12/2006 | ..... | D06F 29/00 |
| EP | 2518205 | A1 * | 10/2012 | ..... | D06F 39/12 |
| EP | 3521501 | | 8/2019 | | |
| GB | 2221970 | A * | 2/1990 | ..... | D06F 29/00 |
| KR | 20060005849 | | 1/2006 | | |
| KR | 20110110660 | | 10/2011 | | |
| KR | 20130027926 | A * | 3/2013 | ..... | D06F 31/00 |
| KR | 20180074489 | | 7/2018 | | |
| RU | 2007140256 | | 5/2009 | | |
| WO | WO-2014101966 | A1 * | 7/2014 | ..... | D06F 29/00 |

OTHER PUBLICATIONS

Office Action in Chinese Appln. No. 202110230798.9, dated Dec. 2, 2022, 12 pages (with English translation).

* cited by examiner

LAUNDRY TREATING APPARATUS AND ASSEMBLY METHOD OF THE SAME

CROSS-REFERENCE TO RELATED APPLICATION

This application claims the benefit of the Korean Patent Application No. 10-2020-0028407, filed on Mar. 6, 2020, which is hereby incorporated by reference as if fully set forth herein.

TECHNICAL FIELD

The present disclosure relates to a laundry treating apparatus and an assembly method of the same.

BACKGROUND

A laundry treating apparatus collectively refers to a laundry washing apparatus, a laundry drying apparatus, and a laundry washing and drying apparatus.

A laundry treating apparatus of the related art is provided to include a drying machine for drying laundry, a washing machine for washing laundry, and a rack for providing a space where any one of the drying machine and the washing machine may be positioned on the other one. The laundry treating apparatus in which the drying machine and the washing machine are stacked on the rack up and down has an advantage in that a user may easily move washed laundry from the washing machine to the drying machine.

However, such a laundry treating apparatus of the related art needs a separate rack to position any one of the drying machine and the washing machine on the other one, and in this case, a problem occurs in that a manufacturing cost is increased due to a large volume of the rack.

Also, since the aforementioned rack provides only a space where any one of the washing machine and the drying machine can be positioned on the other one, a problem occurs in that the rack fails to easily carry the washing machine or the drying machine positioned on the top.

SUMMARY

Accordingly, the present disclosure is directed to a laundry treating apparatus and an assembly method of the same, which substantially obviate one or more problems due to limitations and disadvantages of the related art.

An object of the present disclosure is to provide a laundry treating apparatus comprising a guide panel provided to easily carry one of two treating apparatuses capable of washing and drying laundry on the other one.

Another object of the present disclosure is to provide a laundry treating apparatus comprising a rear bracket provided to support one of two treating apparatuses, which is provided on the other one, so as not to be detached from the other one.

Other object of the present disclosure is to provide an assembly method of a laundry treating apparatus in which two treating apparatuses capable of washing and drying laundry are stacked in a single body.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages, particular implementations of the present disclosure provide a method for assembling a laundry treating apparatus having a first treating apparatus and a second treating apparatus. The first treating apparatus may include a first front panel, a first rear panel, first side panels, and a first drum. The first drum is located between the first front panel and the first rear panel, configured to rotate, and configured to receive laundry. The second treating apparatus may include a second front panel, a second rear panel, second side panels, and a second drum. The second front panel may include an upper fastening unit extending from an upper surface of the second front panel. The second drum is located between the second front panel and the second rear panel, configured to rotate, and configured to receive laundry. The first front panel, the first rear panel, and the first side panels are positioned to correspond to the second front panel, the second rear panel, and the second side panels, respectively. The method includes positioning the second treating apparatus on a surface, positioning the first treating apparatus on the second treating apparatus, coupling the upper fastening unit of the second front panel with a lower portion of the first treating apparatus, and coupling a control panel to a panel seating portion that is defined between a lower surface of the first front panel and the upper surface of the second front panel. The upper fastening unit of the second front panel may be disposed to be higher than the lower surface of the first front panel based on the first treating apparatus being positioned on the second treating apparatus.

In some implementations, the method can optionally include one or more of the following features. The method may include, after positioning the second treating apparatus and prior to positioning the first treating apparatus on the second treating apparatus, attaching a guide panel to the second treating apparatus; and after positioning the first treating apparatus on the second treating apparatus and prior to coupling the upper fastening unit, detaching the guide panel from the second treating apparatus. The guide panel may include a guide panel body detachably located at the panel seating portion, and a roller located at the guide panel body and configured to, based on the first treating apparatus being positioned on the second treating apparatus, contact the lower surface of the first treating apparatus and roll relative to the lower surface of the first treating apparatus. The guide panel may be configured to, based on the guide panel being attached to the second treating apparatus, be attached to the panel seating portion that is defined between the lower surface of the first front panel and the upper surface of the second front panel. The guide panel may be configured to, based on the guide panel being detached from the second treating apparatus, be detached from the panel seating portion. The second treating apparatus may include a first frame that is positioned at a rear surface of the second front panel and coupled to the second front panel. The first treating apparatus may include a connection member that is positioned at lower portions of the first side panels and configured to be coupled to the first frame. The second front panel may be configured to, based on the first frame being coupled to the upper fastening unit and the connection member as the upper fastening unit of the second front panel is coupled with the lower portion of the first treating apparatus, be coupled to the lower portion of the first treating apparatus. The method may include, prior to positioning the first treating apparatus on the second treating apparatus, coupling a rear bracket to the second rear panel, the rear bracket configured to support the first treating apparatus to restrict the first treating apparatus from being detached behind the second treating apparatus. The method may include, after coupling the upper fastening unit of the second front panel with the lower portion of the first treating apparatus, coupling the rear bracket to the first rear panel.

Particular implementations of the present disclosure provide a laundry treating apparatus that includes first and second treating apparatuses, a panel seating portion, a guide panel, and a control panel. The first treating apparatus may include a first front panel, a first rear panel, first side panels, and a first drum. The first drum may be located between the first front panel and the first rear panel, configured to rotate, and configured to receive laundry. The second treating apparatus may be configured to support the first treating apparatus and include a second front panel, a second rear panel, second side panels, and a second drum. The second front panel may include an upper fastening unit extending from an upper surface of the second front panel. The second front panel, the second rear panel, and the second side panels may be positioned to correspond to the first front panel, the first rear panel, and the first side panels, respectively. The second drum may be located between the second front panel and the second rear panel, configured to rotate, and configured to receive laundry. The panel seating portion may be defined between a lower surface of the first front panel and an upper surface of the second front panel. The guide panel may include (i) a guide panel body that is detachably located at the panel seating portion, and (ii) a roller located at the guide panel body and configured to, based on the first treating apparatus being positioned on the second treating apparatus, contact the lower surface of the first treating apparatus and roll relative to the lower surface of the first treating apparatus. The control panel may be configured to be coupled to the panel seating portion based on the guide panel being removed.

In some implementations, the apparatus can optionally include one or more of the following features. The upper fastening unit of the second front panel may be positioned to be higher than the lower surface of the first treating apparatus and coupled to a lower portion of the first treating apparatus. The panel seating portion may include a first panel accommodating portion defined by the upper surface of the second front panel being partially recessed. A lower surface of the guide panel body may include a first protrusion that is partially protruded. The first protrusion and the first panel accommodating portion may be configured to, based on the guide panel being seated on the panel seating portion, face each other. The first protrusion may be configured to, based on the guide panel being seated on the panel seating portion, be inserted into the first panel accommodating portion and coupled to the upper surface of the second front panel. The second treating apparatus may include a first frame positioned at a rear surface of the second front panel and coupled to the second front panel. An upper portion of the first frame may be positioned to be higher than the upper surface of the second front panel. A lower portion of the first frame may be positioned to be lower than the upper surface of the second front panel. The first treating apparatus may include a connection member positioned at lower portions of the first side panels and configured to be coupled to the first frame of the second treating apparatus. The first frame of the second treating apparatus may be configured to be coupled to the lower portions of the first side panels through the connection member based on the first treating apparatus being seated on the second treating apparatus. The first frame of the second treating apparatus may include a second panel accommodating portion defined by the upper portion of the first frame being partially recessed. A first side of the guide panel body may include a second protrusion partially protruded. The second protrusion and the second panel accommodating portion may be configured to face each other based on the guide panel being seated on the panel seating portion. The second protrusion may be configured to be inserted into the second panel accommodating portion and coupled to the upper portion of the first frame based on the guide panel being seated on the panel seating portion. A first side of the guide panel body may be configured to be positioned ahead of the second front panel based on the guide panel being seated on the panel seating portion. The first panel accommodating portion and the first frame together may define a rectangular shape. The first protrusion may have a shape corresponding to the rectangular shape of the first panel accommodating portion and the first frame. The first treating apparatus may include a second frame positioned between the first front panel and the second front panel and coupled to a lower portion of the first treating apparatus. The second frame of the first treating apparatus may include first side extension portions located at opposing lateral sides. The control panel may include second side extension portions located to correspond to the first side extension portions. The first side extension portions and the second side extension portions may be configured to, based on the control panel being coupled to the panel seating portion, overlap with each other and be fastened to each other. The laundry treating apparatus may include a rear bracket configured to be coupled to each of the first rear panel and the second rear panel and support the first treating apparatus to thereby restrict the first treating apparatus from being detached behind the second treating apparatus. The rear bracket may include a handle that defines a space for accommodating a user's hand. An end of the rear bracket may be fixed to the first rear panel and an opposite end of the rear bracket is fixed to the second rear panel. The rear bracket may be configured to partially cover the upper surface of the second rear panel. The first treating apparatus may include a first handle that is defined at each the first side panels and configured to engage with a user's hand to thereby allow a user to lift the first treating apparatus. The first treating apparatus may include a second handle that is defined at the first rear panel and configured to engage with the user's hand to thereby allow the user to lift the first treating apparatus. The first treating apparatus may include a lower panel configured to be supported by the second treating apparatus, and a third handle defined at the lower panel and configured to engage with the user's hand to thereby allow the user to lift the first treating apparatus.

To achieve these objects and other advantages and in accordance with the purpose of the disclosure, as embodied and broadly described herein, an assembly method of a laundry treating apparatus according to exemplary embodiments of the present disclosure comprises a first step of positioning a second treating apparatus in a desired place for assembly; a second step of seating a first treating apparatus on the second treating apparatus; a third step of coupling an upper portion of the second treating apparatus to a lower portion of the first treating apparatus; and a fourth step of coupling a control panel onto the second treating apparatus. A second front panel constituting a front surface of the second treating apparatus may be provided to have an upper fastening unit bent from an upper surface and extended to an upper portion, a first side panel located at both sides of a side direction of the first treating apparatus may be provided to have a connection member provided to be coupled with the upper fastening unit, and the upper fastening unit may be coupled to the lower portion of the first treating apparatus through the connection member of the first side panel when the third step is performed.

An assembly method of a laundry treating apparatus according to exemplary embodiments of the present disclosure comprises a first step of positioning a second treating apparatus in a desired place for assembly, the second treating apparatus including a second front panel forming a front surface, provided with an upper fastening unit bent from an upper surface and extended to an upper portion, a second rear panel forming a rear surface, a second side panel located at both sides of a side direction, and a second drum rotatably provided between the second front panel and the second rear panel, providing a space in which laundry is stored; a second step of seating a first treating apparatus on the second treating apparatus, the first treating apparatus including a first front panel positioned in the same direction as that of the second front panel, forming a front surface, a first rear panel positioned in the same direction as that of the second rear panel, forming a rear surface, a first side panel positioned in the same direction as that of the second side panel and located at both sides of the side direction, and a first drum rotatably provided between the first front panel and the first rear panel, providing a space in which laundry is stored; a third step of coupling the upper fastening unit with a lower portion of the first treating apparatus through a connection member of the first side panel; and a fourth step of coupling a control panel onto a panel seating portion provided between a lower surface of the first front panel and the upper surface of the second front panel, wherein the upper fastening unit may be positioned to be higher than the lower surface of the first treating apparatus after the second step is performed, and the first step to the fourth step may sequentially be performed.

The assembly method of the laundry treating apparatus according to one embodiment of the present disclosure may further comprise a fifth step of attaching a guide panel onto the second treating apparatus before the second step is performed after the first step is performed; and a sixth step of detaching the guide panel from the second treating apparatus before the third step is performed after the second step is performed.

The guide panel may be provided to include a guide panel body detachably provided in the panel seating portion, and a roller provided on the guide panel body, performing a rolling motion in contact with the lower surface of the first treating apparatus when the second step is performed. The guide panel may be attached to the panel seating portion provided between the lower surface of the first front panel and the upper surface of the second front panel when the fifth step is performed, and the guide panel may be detached from the panel seating portion when the sixth step is performed.

The second treating apparatus may further include a first frame provided on the rear surface of the second front panel and coupled to the second front panel, the first treating apparatus may further include a connection member provided at a lower portion of the first side panel and provided to be coupled to the first frame, and the second front panel may be coupled to the lower portion of the first treating apparatus as the first frame is coupled to the upper fastening unit and the connection member respectively when the third step is performed.

The assembly method of the laundry treating apparatus according to one embodiment of the present disclosure may further comprise a seventh step of coupling a rear bracket to the second rear panel, the rear bracket supporting the first treating apparatus to allow the first treating apparatus not to be detached behind the second treating apparatus; and an eighth step of coupling the rear bracket to the first rear panel, wherein the seventh step may be performed before the second step, and the eighth step may be performed after the third step.

A laundry treating apparatus according to exemplary embodiments of the present disclosure comprises a second treating apparatus including a second front panel forming a front surface, a second rear panel forming a rear surface, a second upper panel forming an upper surface, and a second drum rotatably provided between the second front panel and the second rear panel, providing a space in which laundry is stored; a panel seating portion provided on an upper surface of the second front panel; a guide panel including a guide panel body detachably provided in the panel seating portion, and a roller provided on the guide panel body, performing a rolling motion; and a control panel provided to be coupled to the panel seating portion when the guide panel is removed. The laundry treating apparatus may further comprise a first treating apparatus, and when the first treating apparatus is seated on the second treating apparatus, the roller of the guide panel may perform a rolling motion in contact with a lower surface of the first treating apparatus. The laundry treating apparatus may further comprise a rear bracket coupled to each of a lower portion of the first treating apparatus and the second rear panel, supporting the first treating apparatus to allow the first treating apparatus not to be detached behind the second rear panel, wherein the rear bracket may partially cover the upper panel.

A laundry treating apparatus according to exemplary embodiments of the present disclosure comprises a first treating apparatus including a first front panel forming a front surface, a first rear panel forming a rear surface, a first side panel located at both sides of a side direction, and a first drum rotatably provided between the first front panel and the first rear panel, providing a space in which laundry is stored; a second treating apparatus including a second front panel positioned in the same direction as that of the first front panel, forming a front surface, and having an upper fastening unit bent from an upper surface and extended to an upper portion, a second rear panel positioned in the same direction as that of the first rear panel, forming a rear surface, a second side panel positioned in the same direction as that of the first side panel and located at both sides of the side direction, and a second drum rotatably provided between the second front panel and the second rear panel, providing a space in which laundry is stored, and supporting the first treating apparatus a panel seating portion provided between a lower surface of the first front panel and an upper surface of the second front panel; a panel seating portion provided between a lower surface of the first front panel and an upper surface of the second front panel; a guide panel including a guide panel body detachably provided in the panel seating portion, and a roller provided on the guide panel body, performing a rolling motion in contact with the lower surface of the first treating apparatus when the first treating apparatus is seated on the second treating apparatus; and a control panel provided to be coupled to the panel seating portion when the guide panel is removed.

The upper fastening unit may be positioned to be higher than the lower surface of the first treating apparatus and coupled to the lower portion of the first treating apparatus.

The panel seating portion may include a first panel accommodating portion formed as the upper surface of the second front panel is partially recessed, a lower surface of the guide panel body may include a first protrusion partially protruded, the first protrusion and the first panel accommodating portion may be located to face each other when the guide panel is seated on the panel seating portion, and the first protrusion may be inserted into the first panel accommodating portion and coupled to the upper surface of the second front panel when the guide panel is seated on the panel seating portion.

The second treating apparatus may further include a first frame provided on the rear surface of the second front panel and coupled to the second front panel, and an upper portion of the first frame may be positioned to be higher than the upper surface of the second front panel and its lower portion may be positioned to be lower than the upper surface of the second front panel.

The first treating apparatus may further include a connection member provided at a lower portion of the first side panel and provided to be coupled to the first frame, and the first frame may be coupled to the lower portion of the first side panel through the connection member when the first treating apparatus is seated on the second treating apparatus.

The first frame may include a second panel accommodating portion formed as the upper portion of the first frame is partially recessed, one side of the guide panel body may include a second protrusion partially protruded, the second protrusion and the second panel accommodating portion may be located to face each other when the guide panel is seated on the panel seating portion, and the second protrusion may be inserted into the second panel accommodating portion and coupled to the upper portion of the first frame when the guide panel is seated on the panel seating portion.

The other side facing one side of the guide panel body may be positioned ahead of the second front panel when the guide panel is seated on the panel seating portion.

The first panel accommodating portion and the first frame may be formed to have a rectangular shape or a rectangular shape having one or more rounded corners when together viewed from the upper portion, and the first protrusion may be formed to have a shape corresponding to the shape of the first panel accommodating portion and the first frame.

The first treating apparatus may further include a second frame provided between the first front panel and the second front panel and coupled to the lower portion of the first treating apparatus.

The second frame may include a first side extension portion located at both sides of a side direction, the control panel may include a second side extension portion located at position corresponding to the first side extension portion, and the first side extension portion and the second side extension portion may be fastened to be overlapped with each other when the control panel is coupled to the panel seating portion.

The laundry treating apparatus according to exemplary embodiments of the present disclosure may further comprise a rear bracket coupled to each of the first rear panel and the second rear panel, supporting the first treating apparatus to allow the first treating apparatus not to be detached behind the second treating apparatus. The rear bracket may be provided to include a handle forming a space for accommodating a user's hand, and one end of the rear bracket may be fixed to the first rear panel and the other end of the rear bracket may be fixed to the second rear panel.

The rear bracket may partially cover the upper surface of the second rear panel.

The first treating apparatus may further include a first side panel located at both sides of the side direction, and a first handle bent to be inserted into the first side panel and provided to allow a user to lift the first treating apparatus.

The first treating apparatus may further include a second handle bent to be inserted into the first rear panel and provided to allow a user to lift the first treating apparatus.

The first treating apparatus may further include a lower panel supported by the second treating apparatus, and a third handle bent to be inserted into the lower panel and provided to allow a user to lift the first treating apparatus.

The laundry treating apparatus according to exemplary embodiments of the present disclosure may comprise a guide panel detachably provided on one of two treating apparatuses capable of washing and drying laundry, which is positioned on a lower portion, and may easily carry the other one of the two treating apparatuses on the treating apparatus positioned on the lower portion by using the guide panel.

Also, the laundry treating apparatus according to exemplary embodiments of the present disclosure may further comprise a rear bracket coupled to each of the two treating apparatuses, and the treating apparatus of the two treating apparatuses, which is carried to the upper portion, may be supported by the rear bracket so as not to be detached from the treating apparatus positioned on the lower portion.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Hereinafter, the embodiments of the present disclosure will be described with reference to the accompanying drawings. The following detailed description is provided to assist full understanding of a method, apparatus and/or system disclosed in the present disclosure. However, this is only exemplary, and the present disclosure is not limited to the following description.

In describing the embodiments of the present disclosure, if detailed description of elements or functions known in respect of the present disclosure is not relevant to the subject matter of the present disclosure, the detailed description will be omitted. The terms which will be described later are selected from generally known and used terms considering their functions in the present disclosure, and may be modified depending on intention of a person skilled in the art, practices, or the like. Accordingly, the terms used herein should be understood not simply by the actual terms used but by the meaning lying within and the description disclosed herein. The terms used herein are intended to describe the embodiments of the present disclosure, and should not be restrictive. It is to be understood that the singular expression used in this specification includes the plural expression unless defined differently on the context. In this description, it is to be understood that the terms such as "include" and "has" are intended to designate that features, numbers, steps, operations, elements, parts, or their combination, which are disclosed in the specification, exist, and are intended not to previously exclude the presence or optional possibility of one or more other features, numbers, steps, operations, elements, parts, or their combinations.

Also, in describing elements of the embodiments of the present disclosure, the terms "first", "second", "A", "B", "(a)", "(b)", etc. may be used. These terms are intended to identify the corresponding elements from the other elements, and basis, order, or number of the corresponding elements are not limited by these terms.

Figure 1:
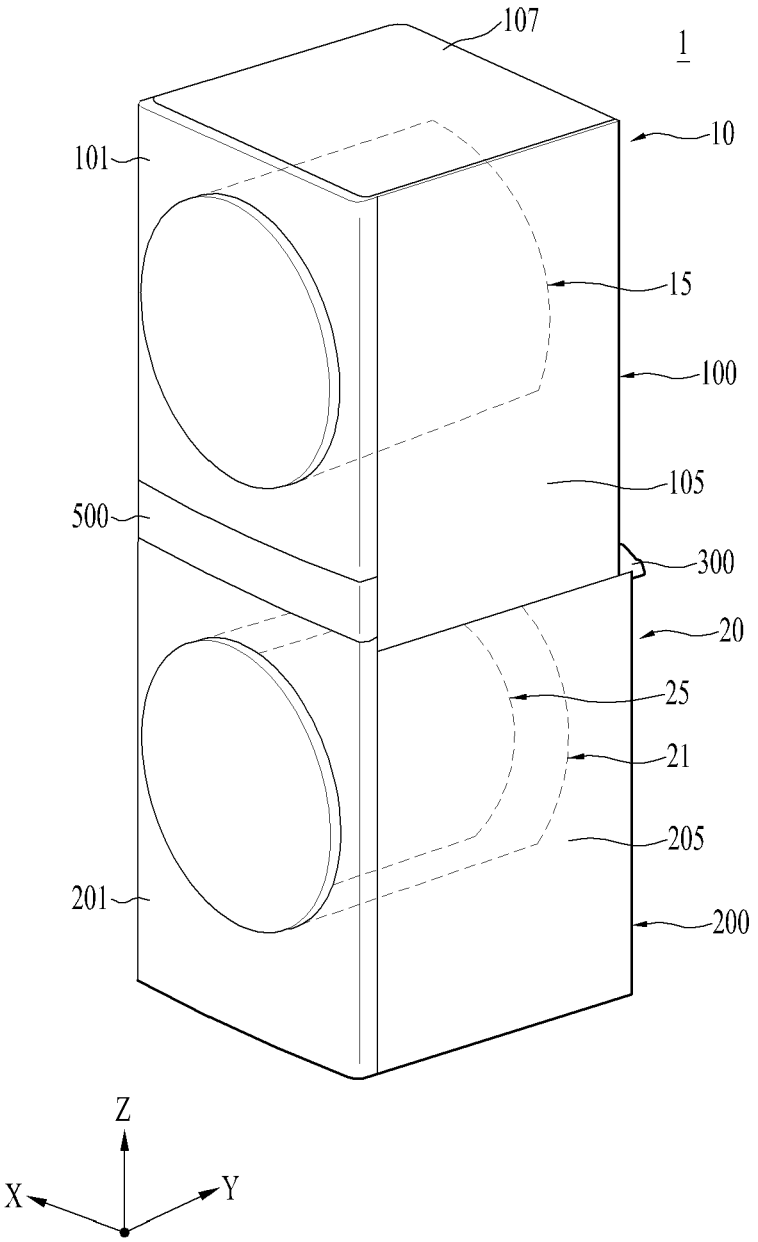
FIGS. 1 to 4 are views illustrating a laundry treating apparatus according to one embodiment of the present disclosure.
Figure 2:
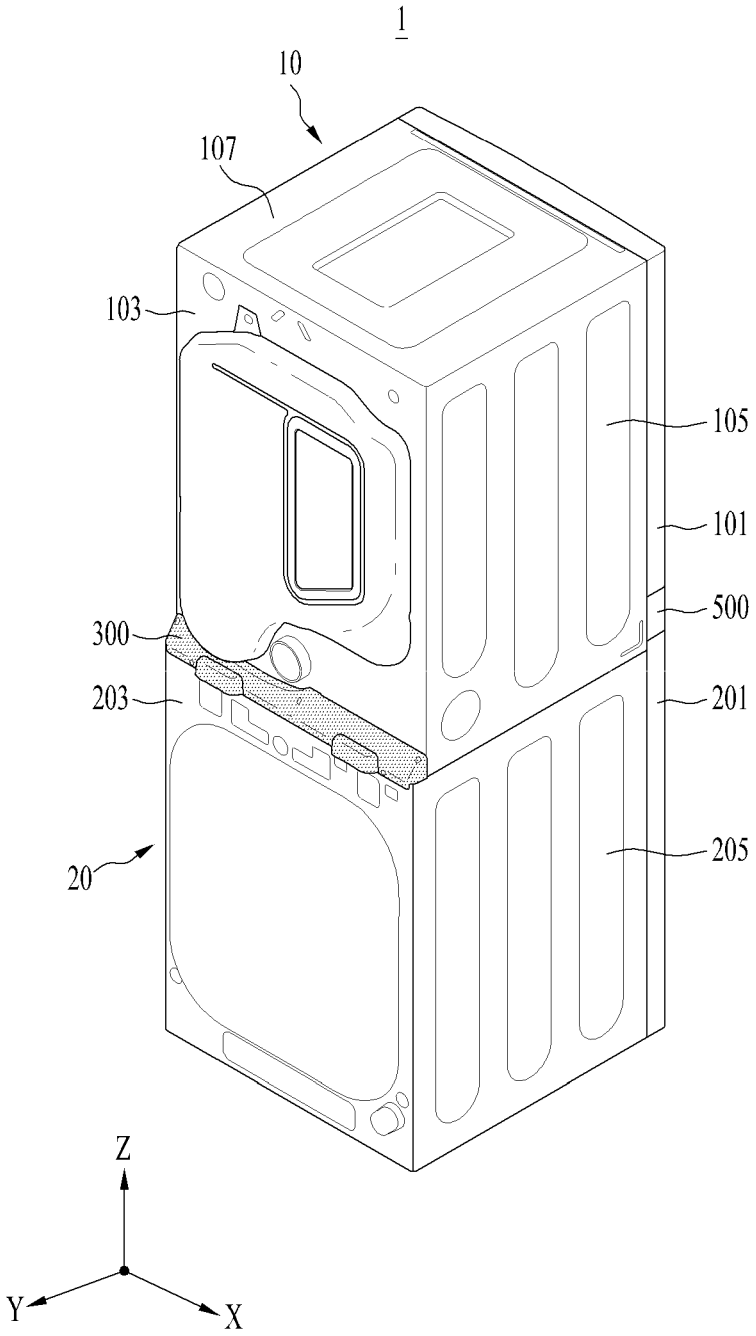
Figure 3:
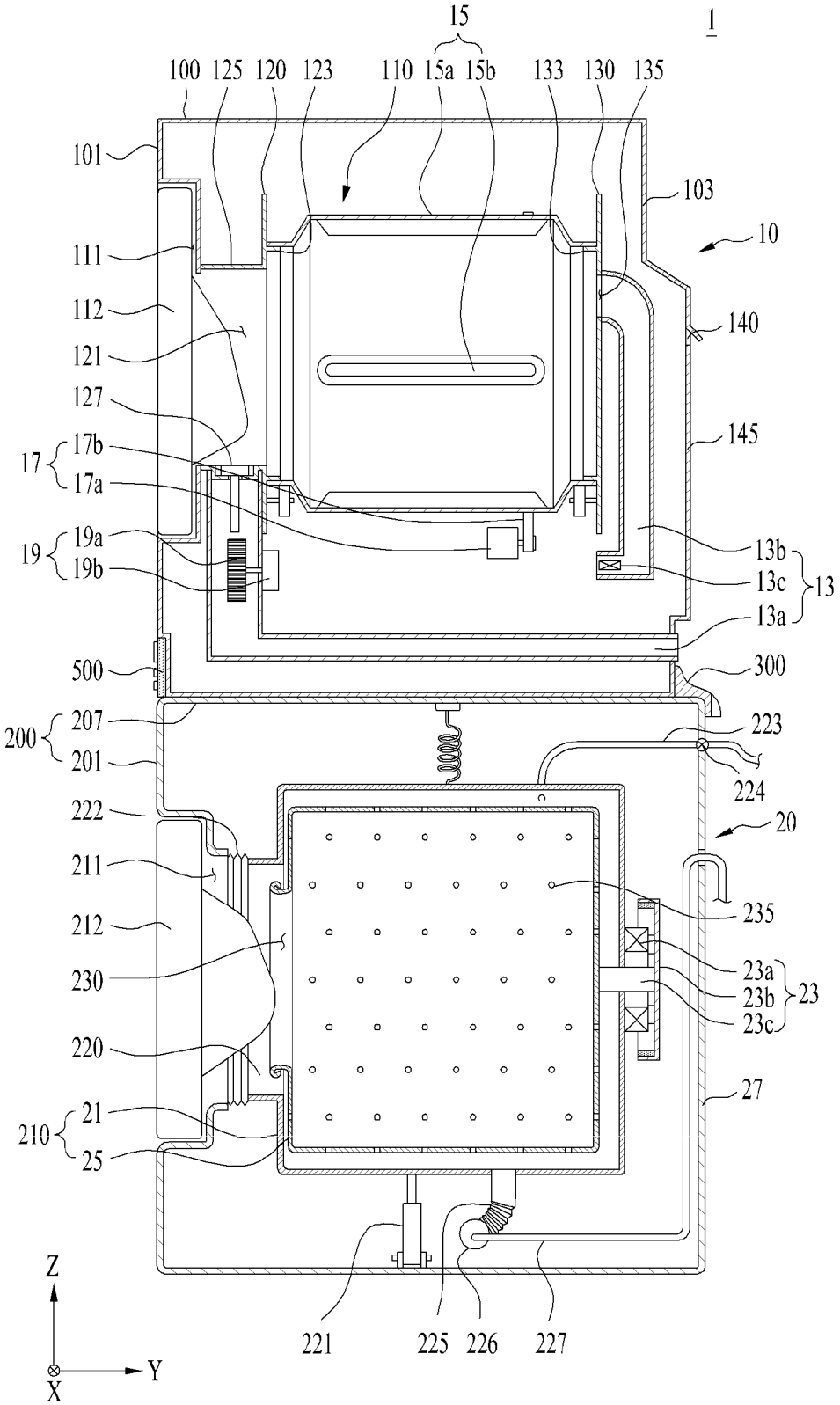
Figure 4:
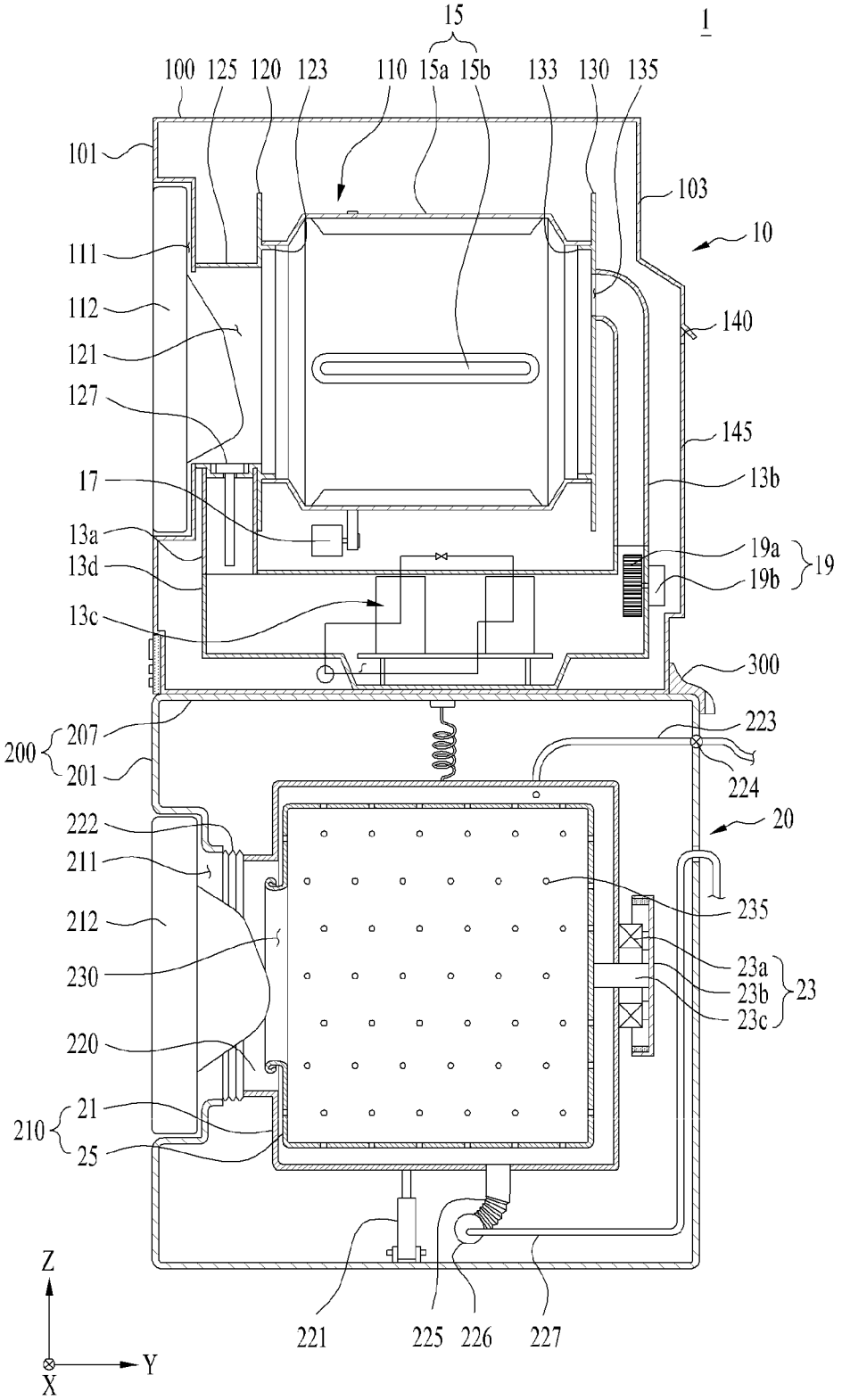

FIGS. 1 to 4 are views illustrating a laundry treating apparatus according to one embodiment of the present disclosure. In detail, FIG. 1 is a perspective view illustrating a laundry treating apparatus according to one embodiment of the present disclosure, FIG. 2 is a perspective view illustrating a laundry treating apparatus of FIG. 1 shown from another angle, FIG. 3 is a sectional view illustrating an inner structure of a laundry treating apparatus according to one embodiment of the present disclosure, and FIG. 4 is a sectional view illustrating an inner structure of a laundry treating apparatus according to another embodiment of the present disclosure.

Hereinafter, two directions orthogonal to each other among directions parallel with the ground will be defined as X direction and Y direction, respectively, and a direction vertical to the ground will be defined as Z direction.

Referring to FIG. 1, the laundry treating apparatus 1 according to one embodiment of the present disclosure may comprise a first treating apparatus 10 and a second treating apparatus 20. The first treating apparatus 10 and the second treating apparatus 20 may be provided as various types for treating laundry, such as a washing machine for washing laundry or a drying machine for drying laundry.

In the exemplary embodiments, the first treating apparatus 10 positioned on the top in FIGS. 1 and 2 is a drying machine for drying laundry and may comprise a first drum 15 therein, and the second treating apparatus 20 positioned on the lower portion, supporting the first treating apparatus 10 is a washing machine for washing laundry, and may comprise a second drum 25 and a tub 21 therein. If the second treating apparatus 20 corresponds to a washing machine, the second drum 25 inside the second treating apparatus 20 may rotatably be provided inside the tub 21.

However, the concept of the present disclosure is not limited to the above case, and both the first treating apparatus 10 and the second treating apparatus 20 may be washing machines or drying machines, or the first treating apparatus 10 may be a washing machine and the second treating apparatus 20 may be a drying machine, or the first treating apparatus 10 and/or the second treating apparatus 20 may be another apparatus for treating other laundry.

The first treating apparatus 10 may include a first cabinet 100 forming an external appearance, and may be provided with a first front panel 101 and a first rear panel 103 at both sides of the Y direction, wherein the first front panel 101 forms a front surface and the first rear panel 103 forms a rea surface. The first front panel 101 may be provided with a laundry opening communicated with the first drum 15, and the laundry opening may be opened or closed by a cabinet door.

Also, a first side panel 105 may be located at both sides of the X direction of the first cabinet 100, and a first upper panel 107 forming an upper surface and a first lower panel forming a lower surface may be located at both sides of the Z direction.

The first front panel 101, the first rear panel 103, the first side panel 105, the first upper panel 107 and the first lower panel may together form the first cabinet 100, and may have a mutual coupling relation. The inside of the first cabinet 100 may be provided with a space where an internal component, such as the first drum 15, which constitutes the first treating apparatus 10, may be provided.

In the first treating apparatus 10, laundry, etc. to be treated may be inserted into the first cabinet 100 through the laundry opening and accommodated in the first drum 15, and a treating process such as washing and drying may be performed by the first treating apparatus 10.

Although FIG. 1 illustrates that the laundry opening is provided on the first front panel 101 together with the cabinet door and the first drum 15 has a rotary shaft extended along the Y direction in accordance with one embodiment of the present disclosure, the laundry opening is not limited to be provided on the first front panel 101 and may be provided on the first side panel 105 or the first upper panel 107 together with the cabinet door. For example, the first treating apparatus 10 may be a front loader type or a top loader type.

The second treating apparatus 20 may include a second cabinet 200 forming an external appearance, and may be provided with a second front panel 201 and a second rear panel 203 at both sides of the Y direction, wherein the second front panel 201 forms a front surface and the second rear panel 203 forms a rea surface. The second front panel 201 may be provided with a laundry opening communicated with the second drum 25, and the laundry opening may be opened or closed by a cabinet door.

Also, a second side panel 205 may be located at both sides of the X direction of the second cabinet 200, and a second upper panel 207 forming an upper surface and a second lower panel forming a lower surface may be located at both sides of the Z direction.

The second front panel 201, the second rear panel 203, the second side panel 205, the second upper panel 207 and the second lower panel may together form the second cabinet 200, and may have a mutual coupling relation. The inside of the second cabinet 200 may be provided with a space where internal components, such as the second drum 25 and a tub 26, which constitute the second treating apparatus 20, may be provided.

In the second treating apparatus 20, laundry, etc. to be treated may be inserted into the second cabinet 200 through the laundry opening and accommodated in the second drum 25, and a treating process such as washing and drying may be performed by the second treating apparatus 20.

Although FIG. 1 illustrates that the laundry opening is provided on the second front panel 201 together with the cabinet door and the second drum 25 has a rotary shaft extended along the Y direction in accordance with one embodiment of the present disclosure, the laundry opening is not limited to be provided on the second front panel 201 and may be provided on the second side panel 205 or the second upper panel 207 together with the cabinet door. For example, the second treating apparatus 20 may be a front loader type or a top loader type.

In the exemplary embodiments, laundry inserted through the first front panel 101 may be accommodated in the first drum 15 and then may be subjected to washing, drying or other treating process, and laundry inserted through the second front panel 201 may be accommodated in the second drum 25 and then may be subjected to washing, drying or other treating process.

The first treating apparatus 10 may be disposed on the second treating apparatus 20. Therefore, the second treating apparatus 20 may support the first treating apparatus 10 in the Z direction. In one embodiment, the second upper panel 207 of the second treating apparatus 20 may have a structure for directly or indirectly supporting the first lower panel of the first treating apparatus 10, and the lower portion of the first treating apparatus 10 and the upper portion of the second treating apparatus 20 may be coupled to each other by a rear bracket 300.

A control panel 500 may be provided between the first front panel 101 and the second front panel 201. The control panel 500 may be provided between the first front panel 101 and the second front panel 201 and then connected with at least one of the first treating apparatus 10 and the second treating apparatus 20 electrically or through a signal. In the exemplary embodiments, the control panel 500 may include a display unit that may display a state of the first treating apparatus 10 and/or the second treating apparatus 20 and an input unit that may input an operation command of the first treating apparatus 10 and/or the second treating apparatus 20. Also, the control panel 500 may be connected with the first treating apparatus 10 and/or the second treating apparatus 20 to transmit and receive state information or a control signal to and from the first treating apparatus 10 and/or the second treating apparatus 20.

In the exemplary embodiments, the control panel 500 may include a controller of the first treating apparatus 10 or a controller of the second treating apparatus 20, or may include an integrated controller for controlling the first treating apparatus 10 and the second treating apparatus 20 together, or may include a panel controller connected to the controller of the first treating apparatus 10 and connected to the controller of the second treating apparatus 20 to control the controllers. Unlike this case, the control panel 500 may be controlled by the controller of the first treating apparatus 10 and the controller of the second treating apparatus 20 without a separate controller.

Referring to FIG. 2, the laundry treating apparatus 1 according to one embodiment of the present disclosure may further comprise a rear bracket 300 coupled to each of the first rear panel 103 and the second rear panel 203, supporting the first treating apparatus 10 so as not to be detached behind the second rear panel 203 along the Y direction. The rear bracket 300 may be coupled to each of a lower portion of the first rear panel 103 and an upper portion of the second rear panel 203, and may partially cover the second upper panel 207.

The rear bracket 300 may be extended along the X direction, and may have a length corresponding to a width of the first treating apparatus 10 or the second treating apparatus 20 in the X direction.

The rear bracket 300 may be coupled with the first rear panel 118 and the second rear panel 128 in various manners. In one embodiment, the rear bracket 300 may be coupled to the first rear panel 103 and the second rear panel 203 through a screw or rivet. Unlike this case, the rear bracket 300 may be coupled to the first rear panel 103 and the second rear panel 203 through hook coupling or fitting coupling.

In the exemplary embodiments, the rear bracket 300 may be made of a material having an electric insulation such as a plastic material, a rubber material and a synthetic material of plastic and rubber. Unlike this case, the rear bracket 300 may be made of a material having electric conductivity such as metal.

As described above, the first treating apparatus 10 and the second treating apparatus 20 may be manufactured separately and then provided to be stacked along the Z direction and used together. At this time, a structural fastening between the first treating apparatus 10 and the second treating apparatus 20, which are mutually stacked, may be required to make sure of structural stability of the laundry treating apparatus 1. Therefore, the first treating apparatus 10 and the second treating apparatus 20, which are stacked along the Z direction, may be provided at a front side and then coupled to each other by a first frame and a second frame, which will be described later, or coupled to each other by the rear bracket 300 provided at a rear side. Meanwhile, the first treating apparatus 10 and the second treating apparatus 20 may be connected with each other by a control panel 500, which is provided at the front side, electrically or through a signal.

Referring to FIG. 3, a first accommodating portion 110 rotatably provided to provide a space in which laundry is stored and a supply unit 13 for supplying the heated air into the first accommodating portion 110 may be provided inside the first cabinet 100 of the first treating apparatus 10.

The first front panel 101 may be provided with a first inlet 111 to be communicated with the first accommodating portion 110, and the first inlet 111 may be provided to be opened or closed by a first door 112 rotatably coupled to the first cabinet 100.

The first drum 15 may rotatably be provided inside the first accommodating portion 110. The first drum 15 may be provided with a drum body 15*a* of a cylindrical shape having front and rear surfaces which are respectively opened. A front support 120 rotatably supporting the front surface of the drum body 15*a* and a rear support 130 rotatably supporting the rear surface of the drum body 15*a* may be provided inside the first cabinet 100.

The front support 120 may be provided to include a first fixed body fixed into the first cabinet 100, and the first fixed body may be provided to include a first drum inlet 121 communicating the first inlet 111 with the inside of the drum body 15*a*, and a first support body 123 inserted into the front surface of the drum body 15*a*.

The first fixed body may be provided in any shape as far as it may include the first drum inlet 121 and the first support body 123. In the exemplary embodiments, the first support body 123 may be provided in a pipe shape protruded from the first fixed body toward the drum body 15*a*, and its diameter may be set to be greater than that of the first drum inlet 121.

The front support 120 may be provided to be connected to the first inlet 111 through a connecting body 125. The connecting body 125 may be provided in a cylindrical shape to surround the first inlet 111. In this case, the first drum inlet 121 may be provided as a through hole connected to the first inlet 111 by passing through the connecting body 125.

An outlet communicated with the supply unit 13 may be provided in the connecting body 125. The outlet may be provided as a hole provided to pass through the connecting body 125, and a filter 127 may detachably be inserted into the outlet. The air inside the drum body 15*a* may move to the supply unit 13 through the outlet and the filter 127, and particles contained in the air in this process may be filtered by the filter 127.

The rear support 130 may be provided to include a second fixed body fixed into the first cabinet 100, and a second support body 133 provided in the second fixed body and inserted into the rear surface of the drum body 15*a*. The rear support 130 may be provided with a supply hole 135 provided to pass through the second fixed body, guiding the air supplied from the supply unit 13 to the drum body 15*a*.

A lifter 15*b* for stirring of laundry may be provided on a circumferential surface of the drum body 15*a*. The lifter 15*b* may be provided as a board protruded from the circumferential surface of the drum body 15*a* toward a rotation center of the drum body 15*a*.

The drum body 15*a* may be rotated by a first driving unit 17, and the first driving unit 17 may be provided to include a first motor 17*a* fixed into the first cabinet 100, a pulley rotated by the first motor 17*a*, and a belt 17*b* connecting a circumferential surface of the pulley with the circumferential surface of the drum body 15*a*.

The supply unit 13 may be provided to include a discharge duct 13*a* guiding the air discharged from the drum body 15*a* to the outside of the first cabinet 100 through the outlet, a supply duct 13*b* supplying the air to the inside of the drum body 15*a* through the supply hole 135, and a heat exchanger 13*c* heating the air entering the supply duct 13*b*. The heat exchanger 47 may be provided as a heater heating the air entering the supply duct 13*b*.

The discharge duct 13*a* may be provided with a fan 19. The fan 19 may be provided to include an impeller 19*a* rotatably provided inside the discharge duct 13*a*, and a fan motor 19*b* rotating the impeller 19*a* if a power is supplied thereto.

One end of the supply duct 13*b* may be connected to the supply hole 135, and its free end may be provided as a pipe arranged inside or outside the first cabinet 100. If the free end of the supply duct 14*b* is arranged inside the first cabinet 100, a through hole 140 may be provided in the first rear panel 103.

Meanwhile, the first rear panel 103 may further include a duct accommodating portion 145 preventing the supply duct 13*b* from interfering with the first rear panel 103. The duct accommodating portion 145 may be protruded to be far away from the first rear panel 103 and provided to form a space in which the supply duct 13*b* may be accommodated.

The second treating apparatus 20 may be provided to include a second cabinet 200 provided to support a bottom surface of the first cabinet 100, and a second accommodating portion 210 provided inside the second cabinet 200, providing a space in which laundry is stored.

The second front panel 201 may be provided with a second inlet 211, and the second inlet 211 may be provided to be opened or closed by a second door 212. If the second treating apparatus 20 is provided as an apparatus for washing laundry, the second accommodating portion 210 may be provided to include a tub 21 provided inside the second cabinet 200, providing a space in which water is stored, and a second drum 25 rotatably provided inside the tub 21, storing laundry therein.

The tub 21 may be fixed to the second cabinet 200 through a tub support 221. A tub inlet 220 communicated to the second inlet 211 may be provided on a front surface of the tub 21, and may be connected to the second inlet 211 through a gasket 222.

The tub 21 is supplied with water through a water supply unit, and is discharged to the outside of the second cabinet 200 through a drainage unit. The water supply unit may be provided to include a water supply pipe 223 connecting a water supply source with the tub 21, and a water supply valve 224 controlling switching of the water supply pipe. The drainage unit may be provided to include a first drainage pipe 225 guiding water inside the tub 21 to the drainage pump 226, and a second drainage pipe 227 guiding water discharged from the drainage pump 226 to the outside of the second cabinet 200.

The second drum 25 may be provided in a hollow cylindrical shape. A second drum inlet 230 communicated with the second inlet 211 through the tub inlet 220 may be provided on the front surface of the second drum 25, and a drum through hole 235 communicating the inside of the second drum 25 with the inside of the tub 21 may be provided on the circumferential surface and the rear surface of the second drum 25.

The second drum 25 may be rotated by a second driving unit 23. The second driving unit 23 may be provided to include a stator 23*a* fixed to the rear surface of the tub 21, forming a rotating magnetic field, a rotor 23*b* rotated by the rotating magnetic field, and a rotary shaft 23*c* connecting the rotor 23*b* with the rear surface of the second drum 25 by passing through the rear surface of the tub 21.

The first treating apparatus 10 and the second treating apparatus 20 may be connected with each other through the rear bracket 300. The rear bracket 300 may be a mechanism for fixing the first treating apparatus 10 to the second treating apparatus 20 by connecting the first rear panel 103 with the second rear panel 203.

FIG. 3 illustrates another embodiment of the laundry treating apparatus 1. The laundry treating apparatus according to this embodiment may also be provided to include a first treating apparatus 10 and a second treating apparatus 20. The laundry treating apparatus of this embodiment may be provided in the same structure as that of the laundry treating apparatus shown in FIG. 1 except the structure of the supply unit 13 provided in the first treating apparatus.

The supply unit 13 shown in FIG. 3 may be provided to include ducts forming a path for re-supplying the air discharged from the first drum 15 to the first accommodating portion 110, and a heat exchanger 18 dehumidifying and heating the air entering the ducts.

The ducts may be provided to include a discharge duct 13*a* connected to the outlet, a supply duct 13*b* connected to the supply hole 135, and a connection duct 13*d* connecting the discharge duct 13*a* with the supply duct 13*b*. The impeller 19*a* of the fan 19 may rotatably be provided inside the connection duct 13*d*.

As described above, the laundry treating apparatus 1 according to one embodiment of the present disclosure may comprise the first treating apparatus 10 positioned on the top and the second treating apparatus 20 positioned on the lower portion to support the first treating apparatus 10. At this time, the first treating apparatus 10 may be provided as a drying machine for drying laundry, and the second treating apparatus 20 may be provided as a washing machine for washing laundry. Meanwhile, although the first treating apparatus 10 may be provided as an exhaust type drying machine as shown in FIG. 3, the concept of the present disclosure is not limited to the exhaust type drying machine, and the first treating apparatus 10 may be provided as a circulating type drying machine as shown in FIG. 4.

FIGS. 5 to 15 are views illustrating an assembly method of a laundry treating apparatus according to one embodiment of the present disclosure.

Figure 5:
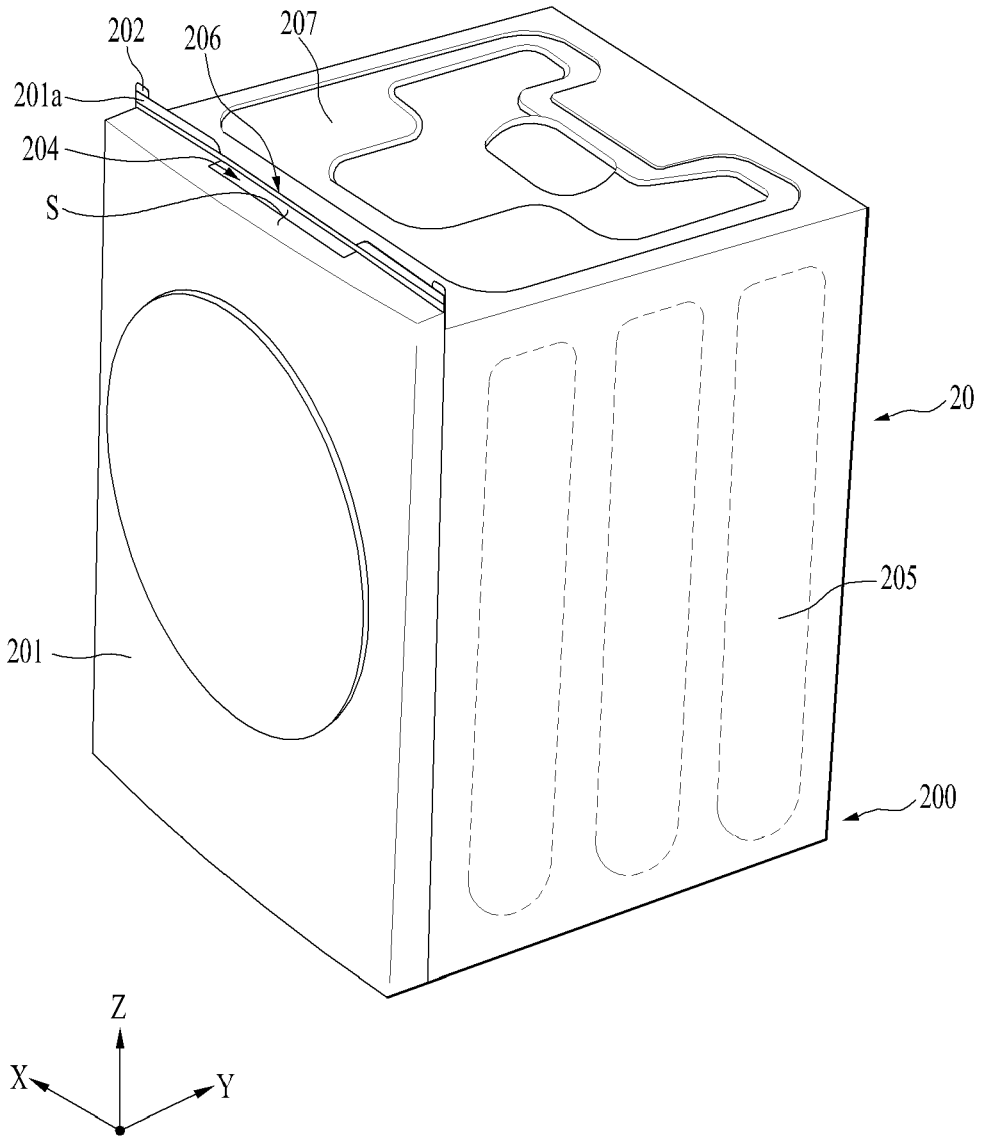
FIGS. 5 to 15 are views illustrating an assembly method of a laundry treating apparatus according to one embodiment of the present disclosure.

Referring to FIG. 5, the second treating apparatus 20 may be positioned on a ground desired to be arranged.

At this time, the second treating apparatus 20 may include a first frame 202 provided between the second front panel 201 and the second upper panel 207 and coupled to a rear surface of the second front panel 201.

In the exemplary embodiments, the second treating apparatus 20 may include an upper fastening unit 201*a* bent from an upper surface 201*b* of the second front panel 201 and extended to an upper portion, and both ends of the first frame 202 may be more protruded toward the upper portion than both ends of the upper fastening unit 201*a*. The upper fastening unit 201*a* may be fastened to the lower portion of the first treating apparatus 10 after being passed through by a second through member (not shown) together with the first frame 202 as described later.

The second treating apparatus 20 may further include a first panel accommodating portion 204 formed as the upper surface 201*b* of the second front panel 201 is partially recessed.

The first frame 202 may include a lower portion extended to adjoin the rear surface of the second front panel 201 facing the second rear panel 203 in the Y direction, and an upper portion extended to be more protruded than the upper surface 201*b* of the second front panel 201. In one embodiment, both ends of the upper portion of the first frame 202 may be formed to be higher than the upper fastening unit 201*a*.

A center portion which is not covered by the upper fastening unit 201*a* in a portion except both ends of the upper portion of the first frame 202 may form a second panel accommodating portion 206.

A space defined by the upper surface 201*b* of the second front panel 201, the first panel accommodating portion 204, the first frame 202 and the second panel accommodating portion 206 may be a portion where a guide panel 400 which will be described later is detachably provided, or may be a portion to which the second frame 102 and the control panel 500, which will be described later, are coupled, after the guide panel 400 is removed. Therefore, the space defined by the upper surface 201*b* of the second front panel 201, the first panel accommodating portion 204 and the second panel accommodating portion 206 will be referred to as a panel seating portion S. In one embodiment, the panel seating portion S may be provided between the lower surface of the first front panel 101 and the upper surface 201*b* of the second front panel 201 after the first treating apparatus 10 is stacked on the second treating apparatus 20.

In the exemplary embodiments, the upper surface 201*b* of the second front panel 201 may be positioned to be higher than the upper surface of the second upper panel 207, and may be positioned to be lower than the upper surface of the first frame 202.

Although FIG. 5 illustrates only the upper portion of the first frame 202 without illustrating the lower portion of the first frame 202, the lower portion of the first frame 202 may be coupled to the rear surface of the second front panel 201 through hook coupling or fitting coupling. The lower portion of the first frame 202 will be described with reference to FIG. 13.

In the exemplary embodiments, the upper portion of the first frame 202 may be positioned to be higher than the upper surface 201*b* of the second front panel 201, and the lower portion of the first frame 202 may be positioned to be lower than the upper surface 201*b* of the second front panel 201.

In the exemplary embodiments, the first panel accommodating portion 204 may be provided to have a rectangular shape or a rectangular shape having one or more rounded corners when viewed from the upper portion together with the first frame 202, and the second panel accommodating portion 206 may be provided to have a concave shape more recessed along the Z direction than the other portions of the first frame 202.

Figure 6:
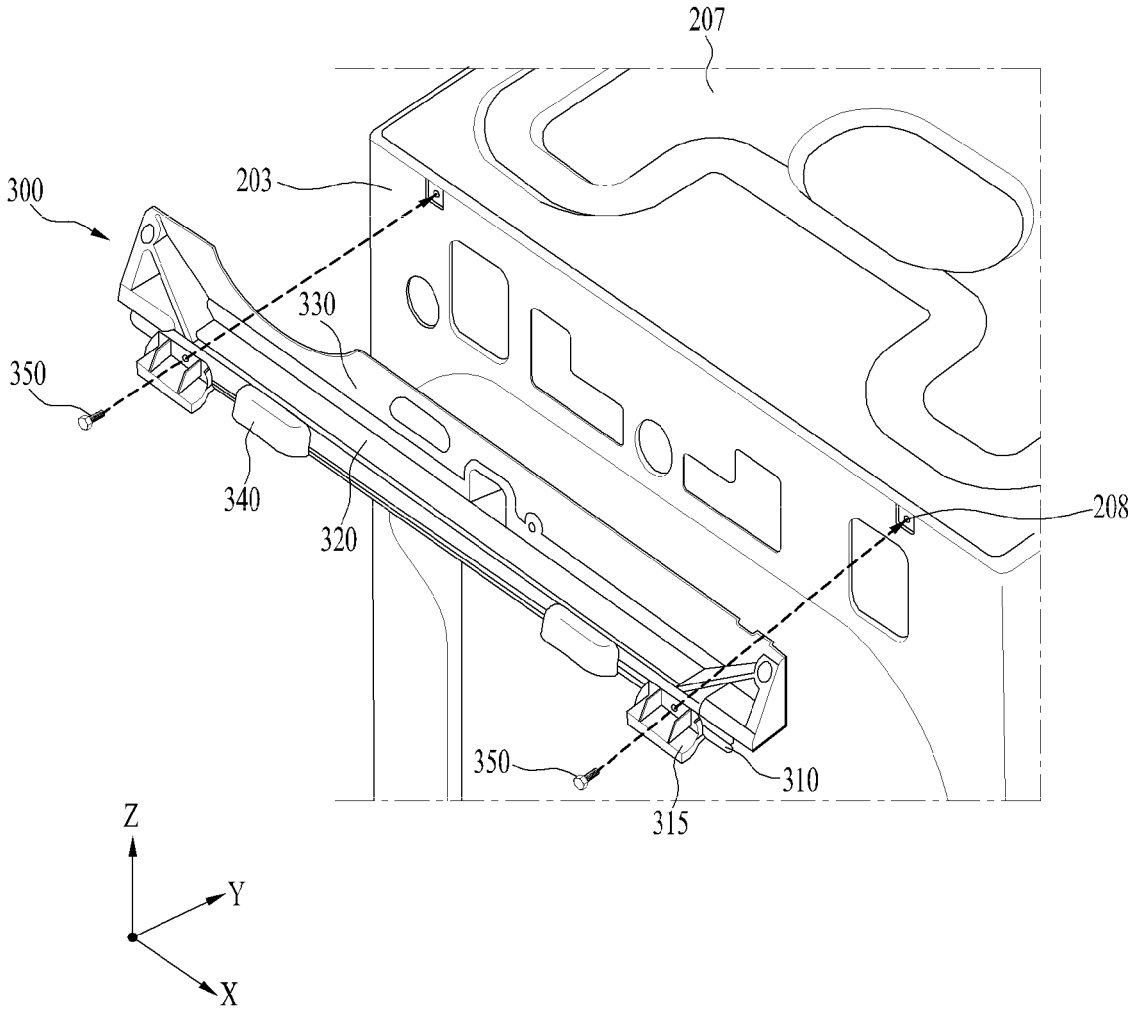

Referring to FIG. 6, the rear bracket 300 may be coupled to the upper portion of the second rear panel 203.

The rear bracket 300 may be provided to include a middle end portion 320 forming a whole external appearance, extended to the X direction, a lower end portion 310 formed below the middle end portion 320 and extended to the X direction, and an upper end portion 330 formed above the middle end portion 320 and extended to the X direction. At this time, the lower end portion 310 of the rear bracket 300 may be formed at one side in the Y direction of the middle end portion 320, and the upper end portion 330 of the rear bracket 300 may be formed at the other side in the Y direction of the middle end portion 320. That is, the lower end portion 310 and the upper end portion 330 of the rear bracket 300 may be provided to have a mutual facing structure based on the middle end portion 320.

A pair of first through coupling portions 208 may be formed above the rear surface of the second rear panel 203, a pair of second through coupling portions 315 may be formed at the lower end portion 310 of the rear bracket 300, and the first through coupling portions 208 and the second through coupling portions 315 may be formed at mutual corresponding positions when both ends of the rear bracket 300 are positioned to be matched with both ends of the second rear panel 203.

The first through coupling portions 208 may be provided to partially pass through the second rear panel 203, the second through coupling portions 315 may be provided to pass through the rear bracket 300, and the first through coupling portions 208 and the second through coupling portions 315 may be fastened by being respectively passed through first through members 350.

The middle end portion 320 of the rear bracket 300 may have a structure in which a plurality of extension portions extended in the X direction are stacked, and may be provided to further include a support member provided to support the upper end portion 330 at both sides of one of the extension portions.

A concave portion and a through portion, which are formed as the upper portion of the rear bracket 300 is partially removed, may be provided on the upper end portion 330 of the rear bracket 300. The concave portion of the upper end portion 330 of the rear bracket 300 may be a portion on which the duct accommodating portion 145 of the first treating apparatus 10 is seated, and the through portion of the upper end portion 330 of the rear bracket 300 may be provided as a hole passing through the connecting body 125 of the first treating apparatus 10, and may be a portion through which the outlet communicated with the supply unit 13 passes.

In the exemplary embodiments, the rear bracket 300 may be coupled to the upper surface of the second upper panel 207 to partially cover the upper surface of the second upper panel 207.

In one embodiment, the rear bracket 300 may be provided to include a handle 340 forming a space capable of accommodating a user's hand.

Figure 7:
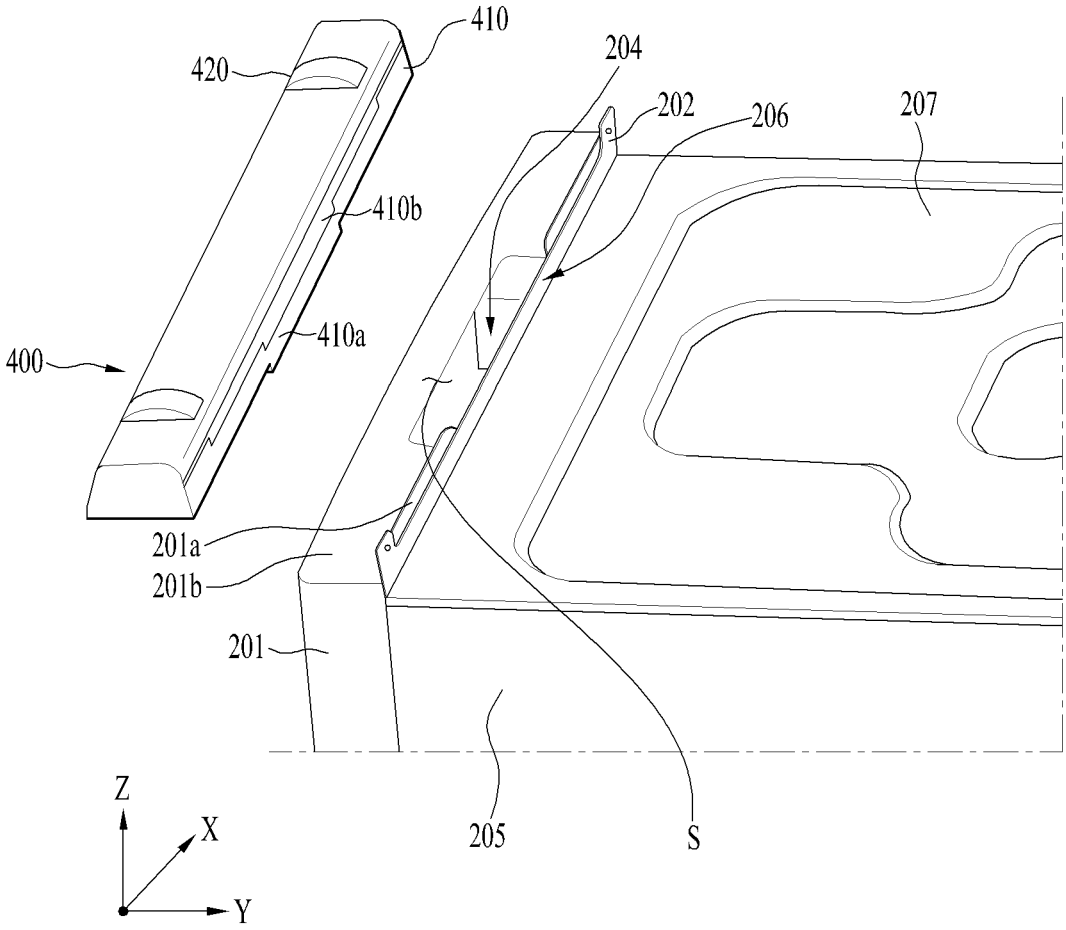
Figure 8:
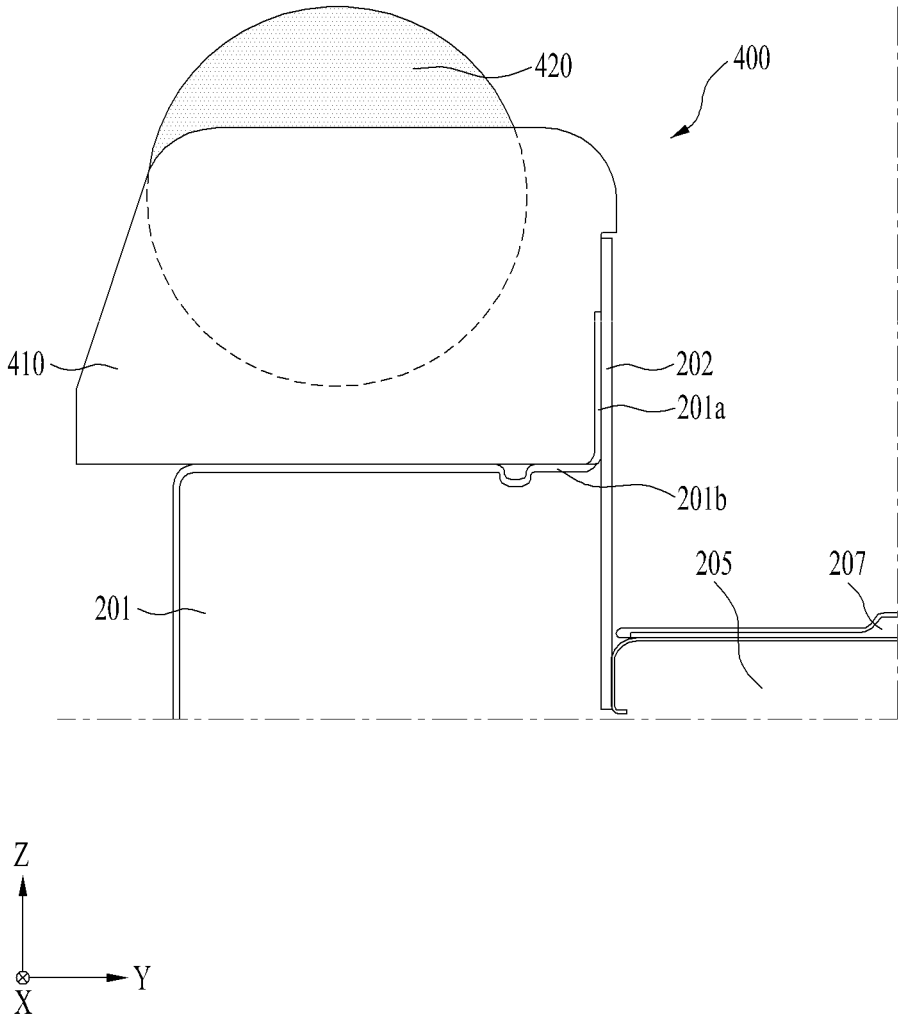

Referring to FIGS. 7 and 8, the guide panel 400 may be attached onto the panel seating portion S provided on the upper portion of the second treating apparatus 20.

The guide panel 400 may be provided to include a guide panel body 410 detachably provided in the panel seating portion, and a roller 420 provided on the guide panel body 410, performing a rolling motion in contact with the lower surface of the first treating apparatus 10 when the first treating apparatus 10 is seated on the second treating apparatus 20.

The guide panel body 410 may be provided to be extended along the X direction, and the roller 420 of the guide panel 400 may be provided to be fixed to both sides of the guide panel body 410 in the X direction.

Although FIG. 7 illustrates that the guide panel 400 includes a pair of rollers 420 respectively fixed to both sides of the guide panel body 410 in the X direction and spaced apart from each other in the X direction, the concept of the present disclosure is not limited to the example of FIG. 7, and the guide panel 400 may include one roller 420 fixed to both sides of the guide panel body 410 in the X direction and extended to the X direction.

The guide panel 400 may be coupled to each of the first panel accommodating portion 204 formed on the upper surface 201*b* of the second front panel 201 and the second panel accommodating portion 206 formed on the upper portion of the first frame 202. The second panel accommodating portion 206 may be provided on a center portion which is not covered by the upper fastening unit 201*a* in the portion except both ends of the upper portion of the first frame 202 relatively protruded in the Z direction.

The lower surface of the guide panel body 410 may be provided to include a first protrusion 410*a* which is partially protruded, wherein the first protrusion 410*a* may be provided to face the first panel accommodating portion 204 when the guide panel 400 is seated on the panel seating portion S. Therefore, the first protrusion 410*a* may be coupled to the upper surface 201*b* by being inserted into the first panel accommodating portion 204 when the guide panel 400 is seated on the panel seating portion S.

When the guide panel 400 is seated on the panel seating portion S, one side of the guide panel body 410 supported by the upper portion of the first frame 202 may be provided to include a second protrusion 410*b* partially protruded along the Y direction, and the second protrusion 410*b* may be provided to face the second panel accommodating portion 206 when the guide panel 400 is seated on the panel seating portion S. Therefore, the second protrusion 410*b* may be coupled to the upper portion of the first frame 202 by being inserted into the second panel accommodating portion 206 when the guide panel 400 is seated on the first frame 202.

In the exemplary embodiments, the other side facing one side of the guide panel body 410 may be positioned ahead of the second front panel 201 in the Y direction when the guide panel 400 is seated on the panel accommodating portion.

In the exemplary embodiments, the lower surface of the guide panel body 410 except the portion where the first protrusion 410*a* is formed may have an area greater than that of the upper surface 201*b* of the second front panel 201 except the portion where the first panel accommodating portion 204 is formed.

In one embodiment, when the guide panel 400 is attached onto the upper surface 201*b* of the second front panel 201, the guide panel 400, the upper fastening unit 201*a* and the first frame 202 may sequentially be stacked along the Y direction.

Figure 9:
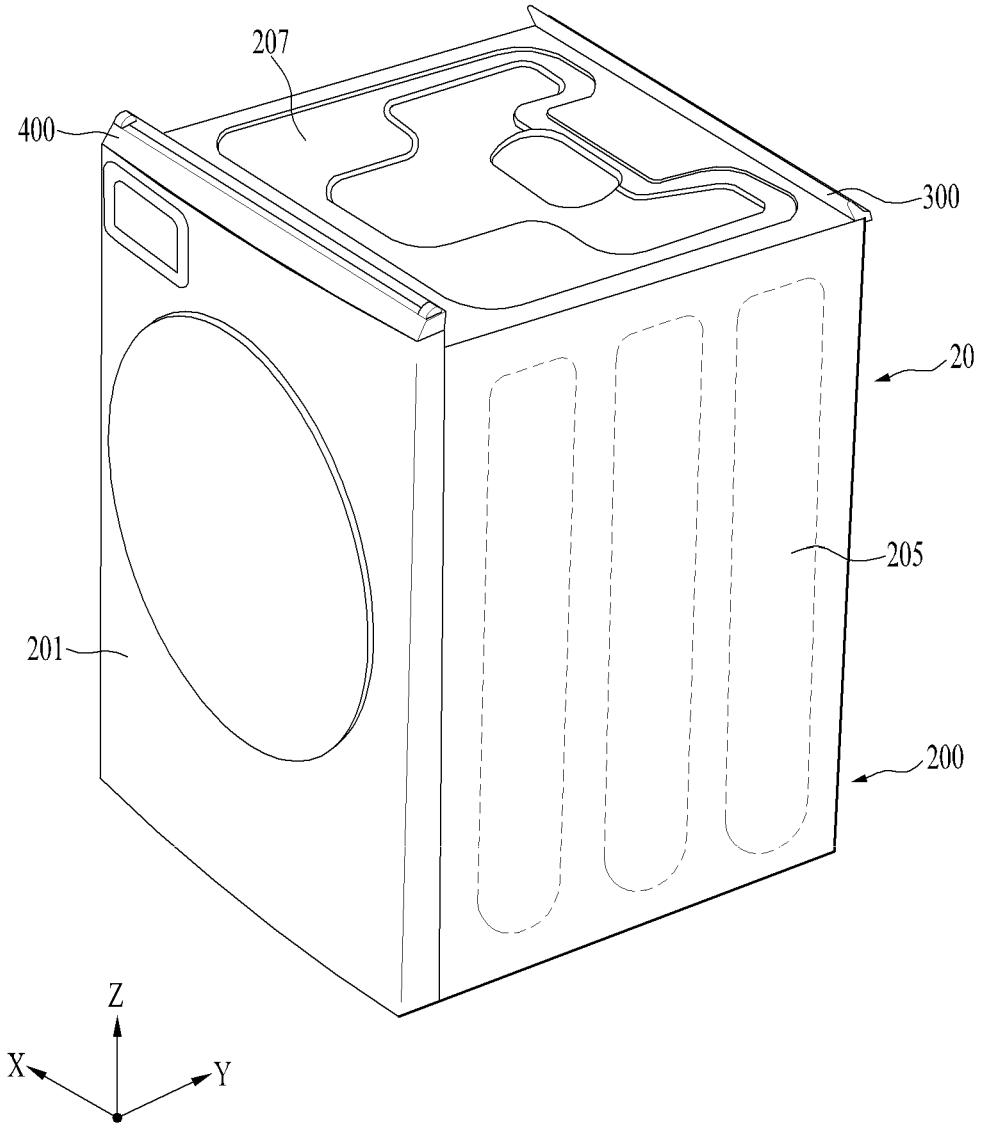
Figure 10:
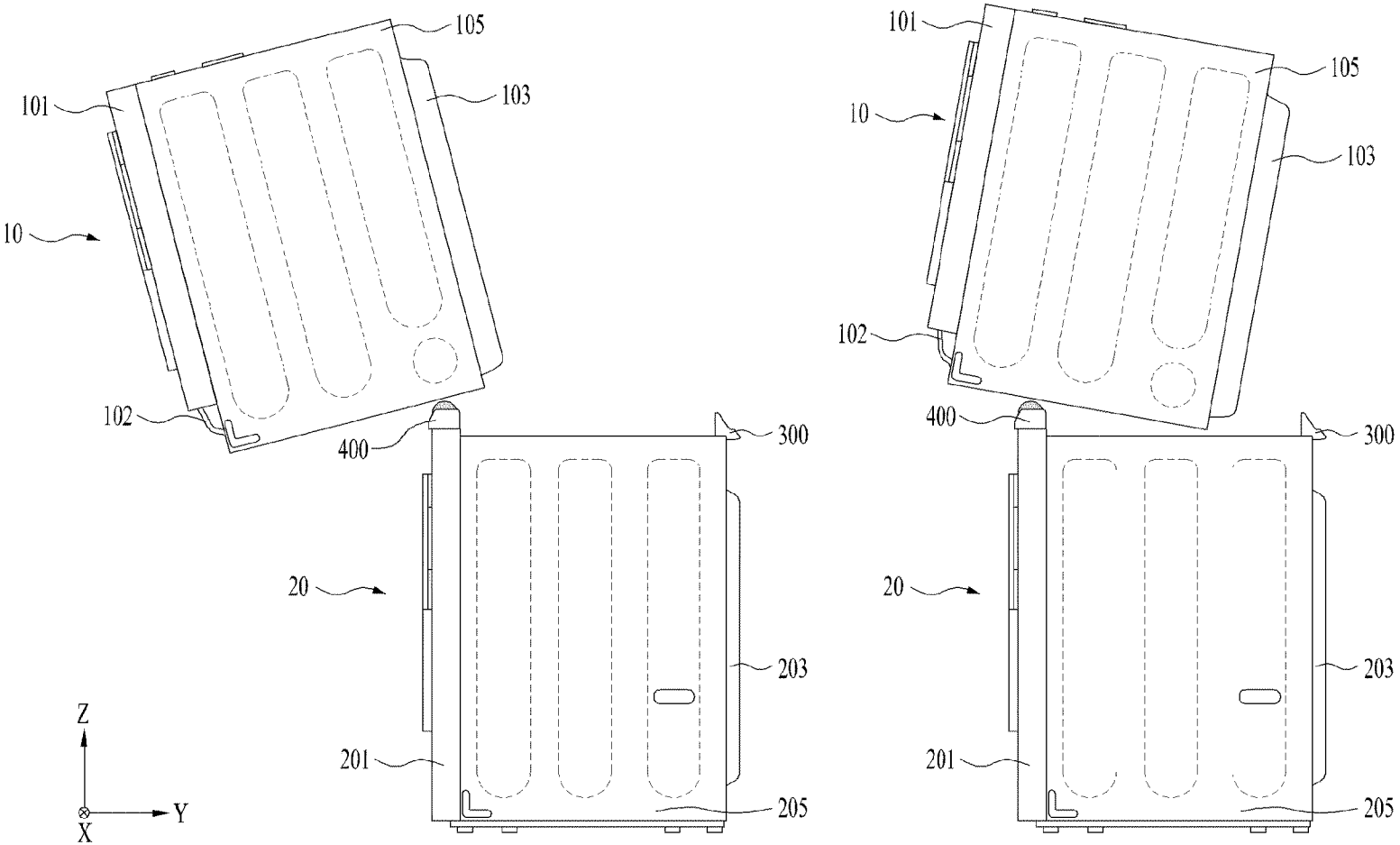
Figure 11:
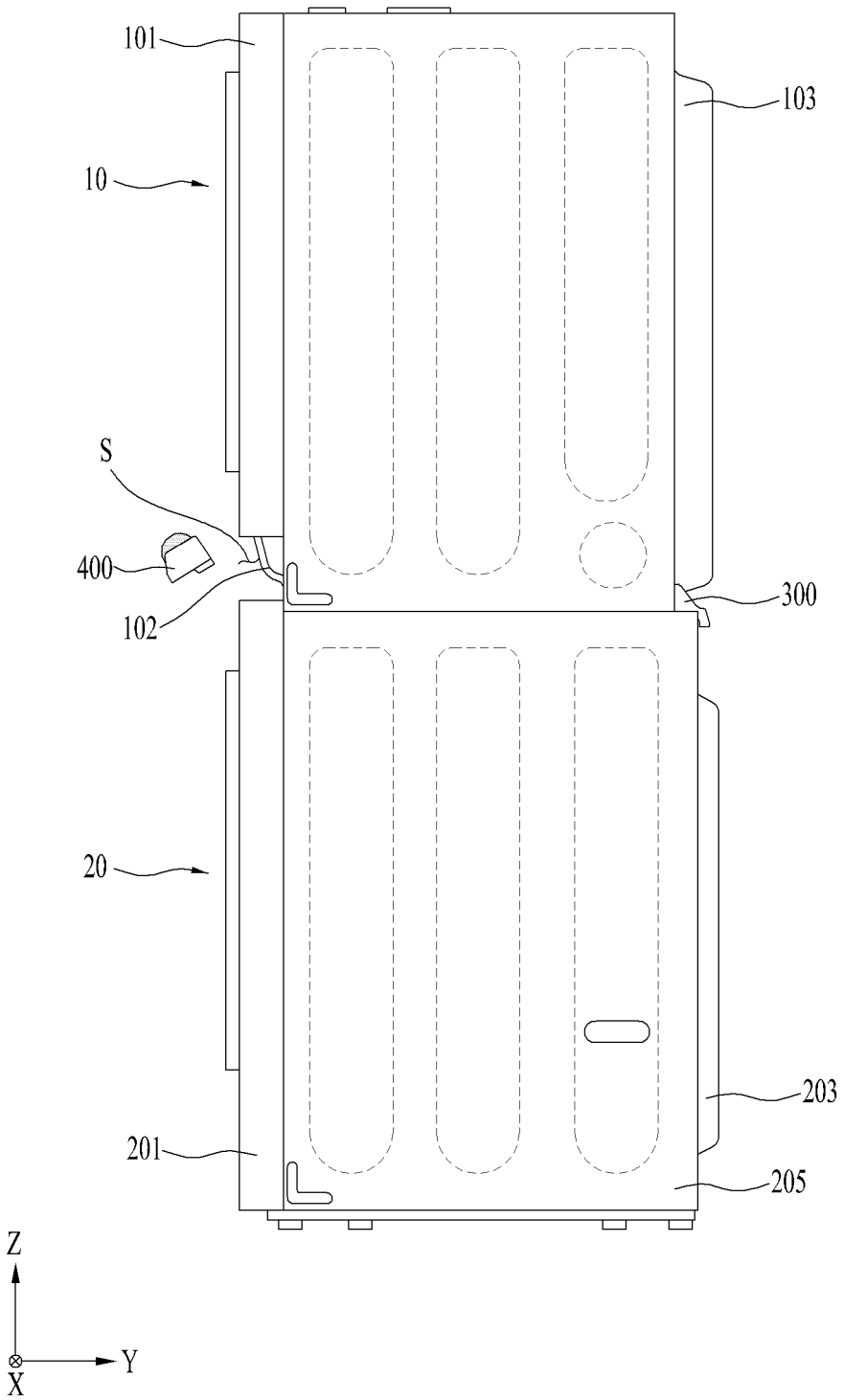

Referring to FIGS. 9 to 11, the first treating apparatus 10 may be stacked on the second treating apparatus 20 in which the rear bracket 300 is coupled to the rear side and the guide panel 400 is attached to the front side.

At this time, the guide panel 400 may perform a rolling motion in contact with the lower surface of the first treating apparatus 10 when the first treating apparatus 10 is seated on the second treating apparatus 20. Therefore, the first treating apparatus 10 may be stacked on the second treating apparatus more actively. Also, the rear bracket 300 may serve to support the first treating apparatus 10 so as not to allow the first treating apparatus 10 from being detached behind the second treating apparatus 20 when the first treating apparatus 10 is seated on the second treating apparatus 20. Therefore, the first treating apparatus 10 may be stacked on the second treating apparatus more stably.

Figure 12:
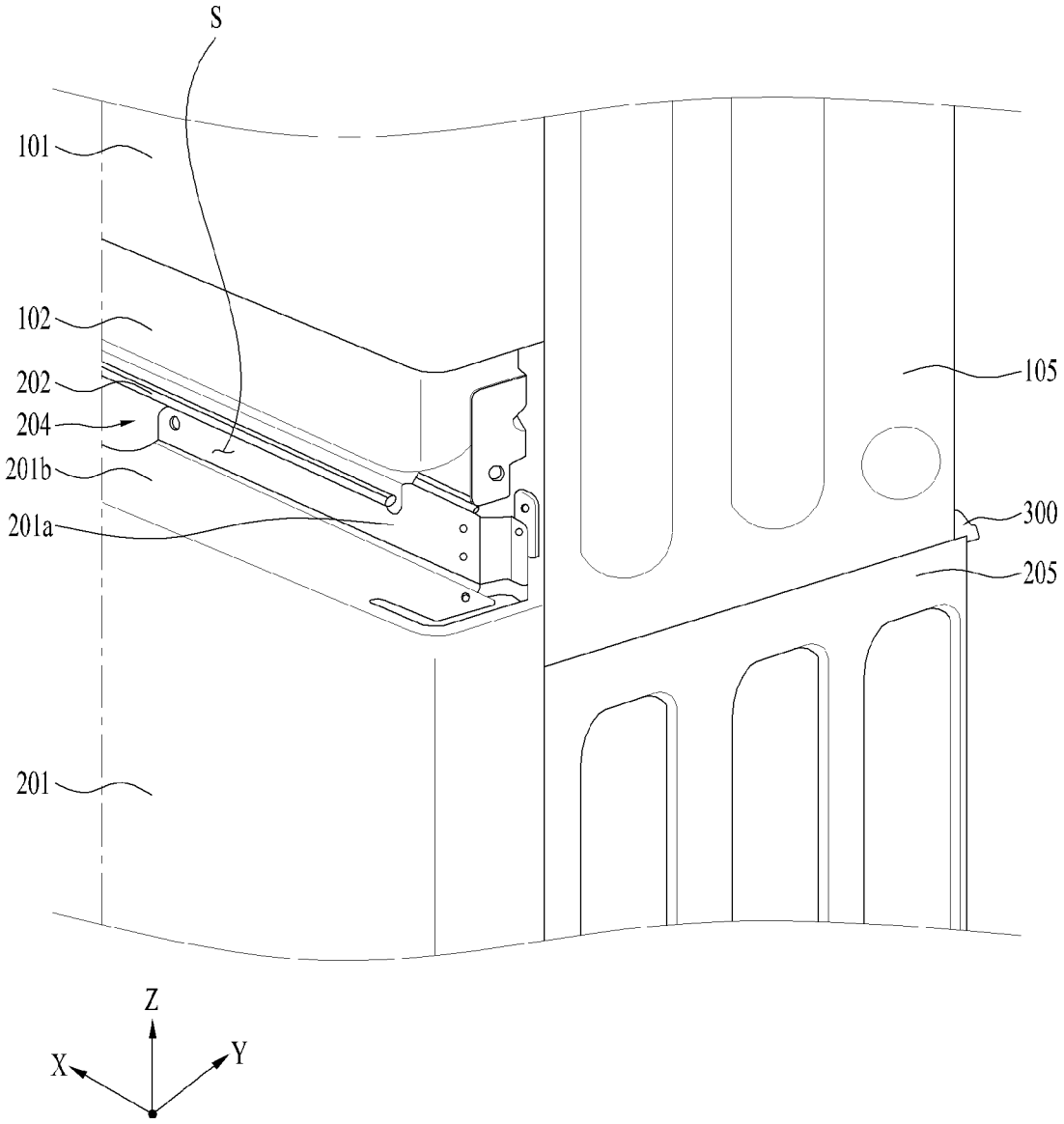
Figure 13:
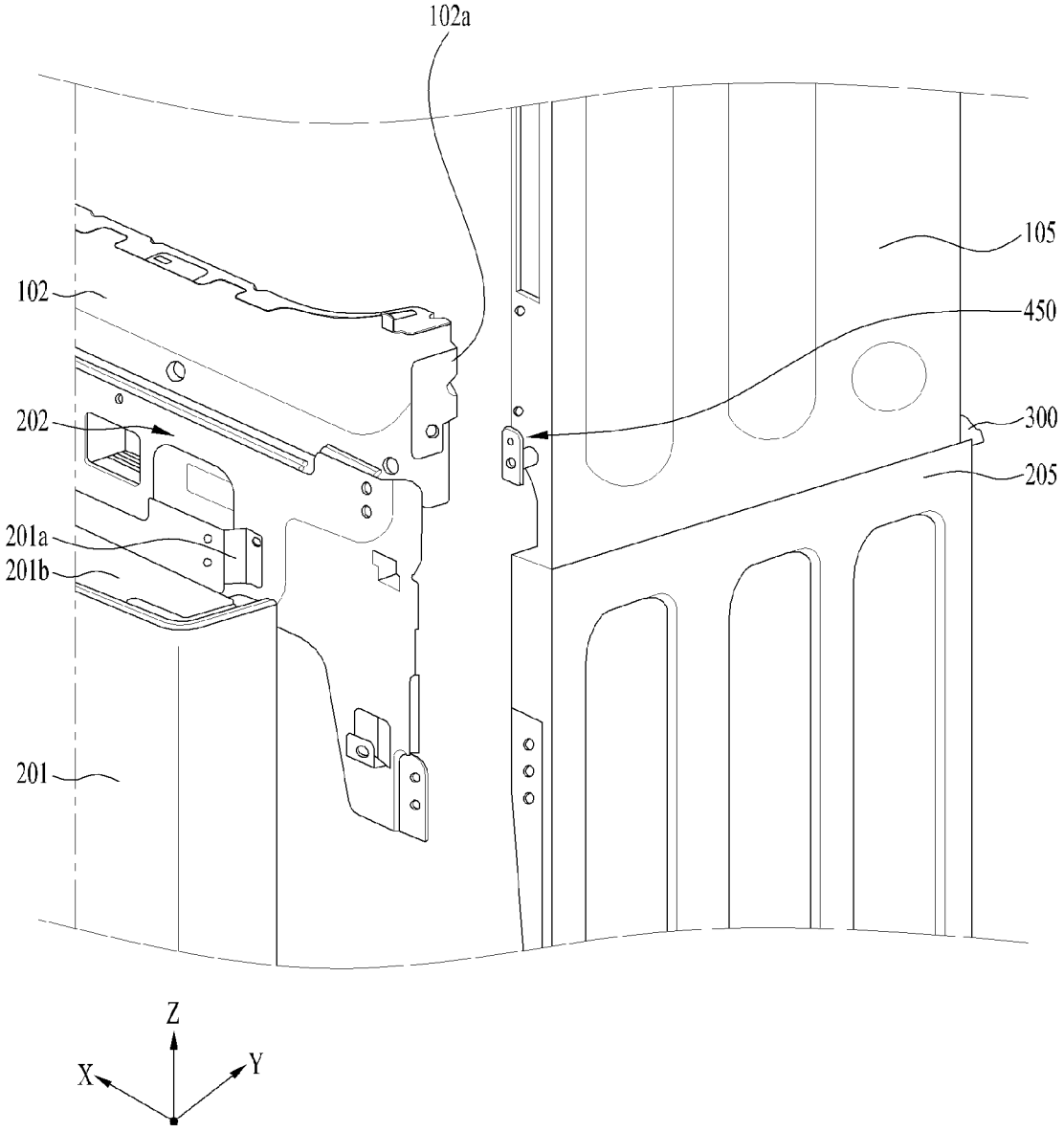

Referring to FIGS. 12 and 13, the first treating apparatus 10 may be provided to further include a second frame 102, wherein the second frame 102 may be coupled to the lower portion of the first front panel 101. The second frame 102 may be provided to be fixedly coupled with the control panel 500 inserted between the first front panel 101 and the second front panel 201. The second frame 102 may be coupled to the first front panel 101 through hook coupling, fitting coupling, etc., for example, or may be fastened to the first treating apparatus 10 through one or more second through members (not shown).

In the exemplary embodiments, the second frame 102 may be coupled to the first side panel 105 of which both ends in the X direction face each other, and various coupling schemes such as screw coupling, rivet coupling and fitting coupling may be used for coupling between the second frame 102 and the first side panel 105.

In the exemplary embodiments, the guide panel 400 may be detached from the panel seating portion S after the first treating apparatus 10 is coupled to the rear bracket 300. Unlike this case, the guide panel 400 may be detached from the panel seating portion S before the first treating apparatus 10 is coupled to the rear bracket 300. In this case, the first treating apparatus 10 and the rear bracket 300 may be coupled to each other after the guide panel 400 is detached from the panel seating portion S. In one embodiment, the first treating apparatus 10 may be coupled to the rear bracket 300 through hook coupling, fitting coupling and/or coupling based on the through member, for example.

After the guide panel 400 is detached from the panel seating portion S, the first frame 202 may be fastened to the first treating apparatus 10 through a third through member 250.

In the exemplary embodiments, if the first treating apparatus 10 is completely stacked, the upper surface 201*b* of the second front panel 201 may be positioned to be higher than the lower surface of the first treating apparatus 10 in the Z direction, and may partially cover the lower portion of the first treating apparatus 10.

Meanwhile, FIG. 13 illustrates the first frame 202 disposed between the upper fastening unit 201*a* and the first side panel 105 in accordance with one embodiment of the present disclosure.

Referring to FIG. 13, the second treating apparatus 20 may include a first frame 202, wherein the first frame 202 may be provided between the second front panel 201 and the second side panel 205 and then coupled to the second side panel 205, and the upper portion positioned above the second side panel 205 may be coupled to the lower portion of the first treating apparatus 10 together with the upper fastening unit 201*a*.

The first frame 202 may be disposed on the rear surface of the second front panel 201, and may be disposed at the front of the second upper panel 207 and the second side panel 205 of the second treating apparatus 20. That is, the first frame 202 may be disposed between the second front panel 201 and the second side panel 205.

The first frame 202 may be extended in the X direction and its both ends may be coupled with the second side panel 205 and may be coupled with the second front panel 201 in a front direction. The first frame 202 may serve to improve structural stability of the upper side in the second treating apparatus 20 and improve rigidity.

The first frame 202 may be fixed to the second treating apparatus 20 and its upper portion extended in the Z direction may be coupled to the lower portion of the first treating apparatus 10. The first frame 202 may have a surface parallel with the second front panel 201.

The first frame 202 may be provided in a plate shape having a surface parallel with the front surface of the second front panel 201, may be disposed between the second front panel 201 and the second side panel 205 in the second treating apparatus 20 and coupled to the second side panel 205, and its upper portion protruded from the second treating apparatus 20 in the Z direction may be disposed between the upper fastening unit 201*a* and the first side panel 105 and coupled to the lower portion of the first treating apparatus 10 together with the upper fastening unit 201*a*.

In the exemplary embodiments, the first treating apparatus 10 may further include a connection member 450 provided at a lower portion of the first side panel 105 and coupled to the first frame 202. After the first treating apparatus 10 is seated on the second treating apparatus 20, the first frame 202 is coupled to the upper fastening unit 201*a* and the connection member 450, whereby the second front panel 201 may be coupled to the lower portion of the first treating apparatus 10.

Figure 14:
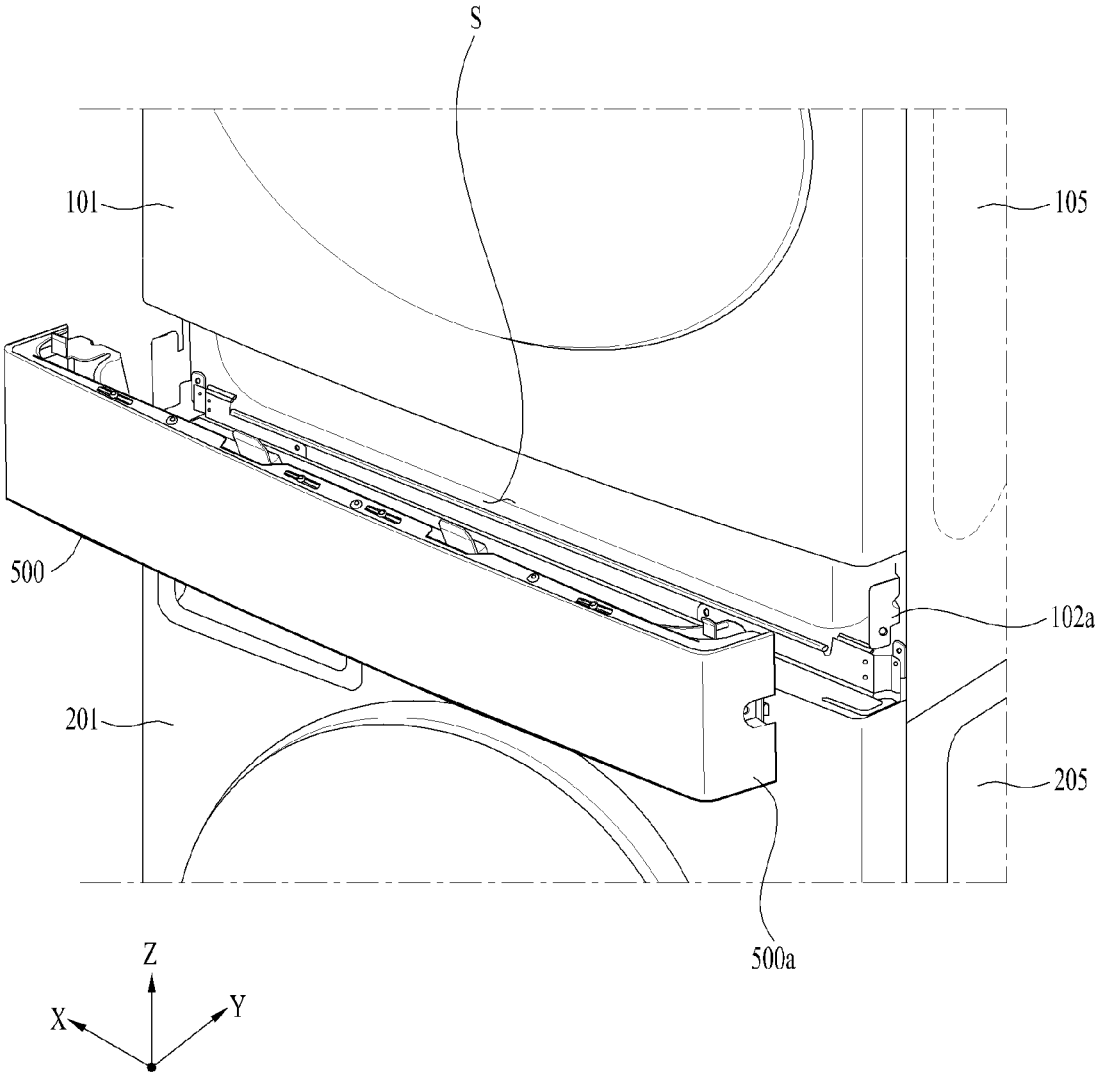
Figure 15:
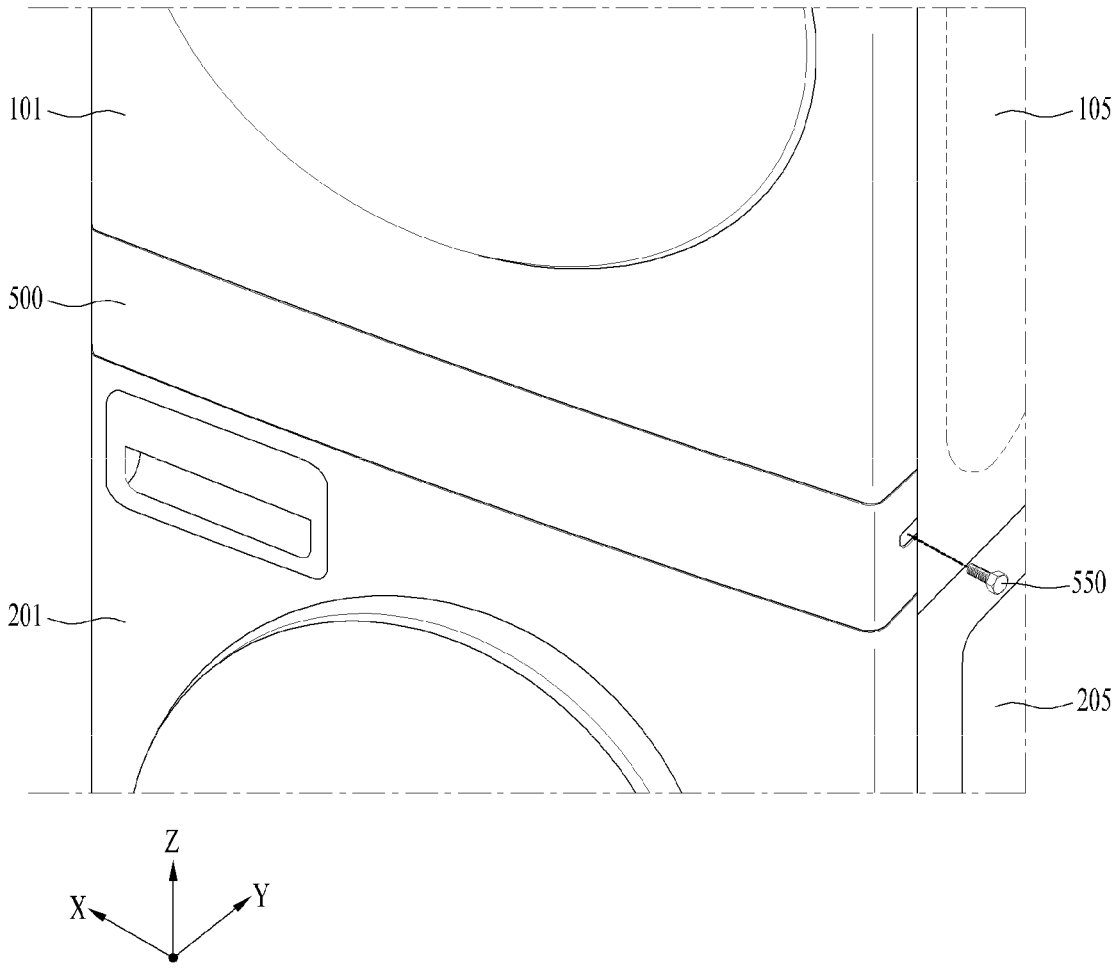

Referring to FIGS. 14 and 15, the control panel 500 may be coupled to the first treating apparatus 10, and the second frame 102 may be coupled with the control panel 500 at the rear of the control panel 500 and fix the control panel 500. At this time, the second frame 102 may be extended along the X direction, and may partition a portion between the inside of the first treating apparatus 10 and the control panel 500.

In the exemplary embodiments, the control panel 500 may be extended along the X direction and thus its both ends may be coupled to both ends of the second frame 102. In one embodiment, both ends of the second frame 102 may be provided to include a third through coupling portion 104, both ends of the control panel 500 may be provided to include a fourth through coupling portion 502, and the third through coupling portion 104 and the fourth through coupling portion 502 may be fastened by being respectively passed through a fourth through member 550. The second frame 102 may include a first side extension portion 102*a* located at both sides of a side direction, and the control panel may include a second side extension portion 500*a* located at the position corresponding to the first side extension portion 102*a*, and the first side extension portion 102*a* and the second side extension portion 500*a* are fastened to be overlapped with each other when the control panel 500 is coupled to the panel seating portion S.

As described above, the guide panel 400 may perform a rolling motion in contact with the lower surface of the first treating apparatus 10 when the first treating apparatus 10 is seated on the second treating apparatus 20, whereby the first treating apparatus 10 may be stacked on the second treating apparatus more actively. Also, the rear bracket 300 may serve to support the first treating apparatus 10 to allow the first treating apparatus 10 not to be detached behind the second treating apparatus 20 when the first treating apparatus 10 is seated on the second treating apparatus 20. Therefore, the first treating apparatus 10 may be stacked more stably.

As described above, the first treating apparatus 10 is assembled as the upper surface of the second upper panel 207 is provided to have a groove of a specific shape and the lower surface of the first treating apparatus 10 is provided to be fitted into the groove of the second upper panel 207. However, the concept of the present disclosure is not limited to this. That is, the second treating apparatus 20 may not include the second upper panel 207, and in this case, a guide device such as a rail may be formed on the second side panel 205. Therefore, the laundry treating apparatus 1 may be assembled as the first treating apparatus 10 is seated on the second treating apparatus 20 along the guide device.

Figure 16:
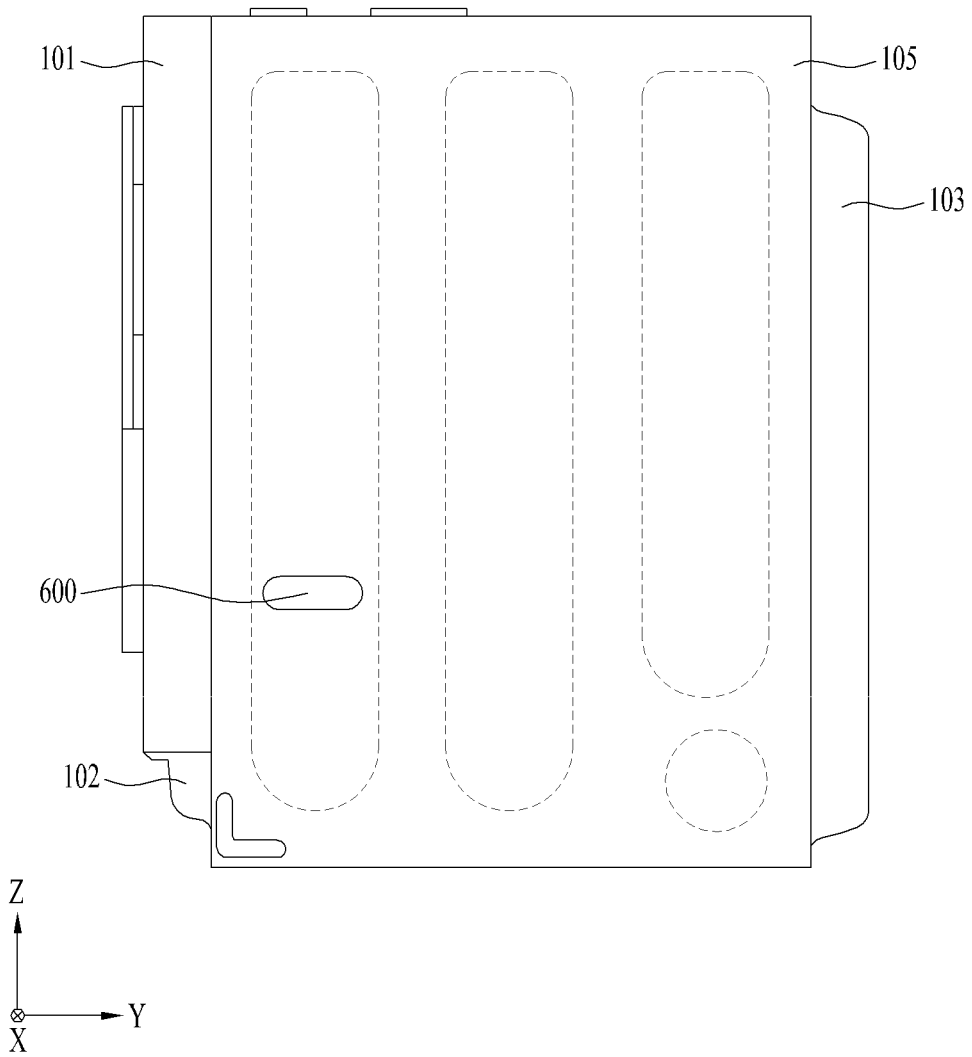
FIGS. 16 to 18 are views illustrating laundry treating apparatuses according to exemplary embodiments of the present disclosure.
Figure 17:
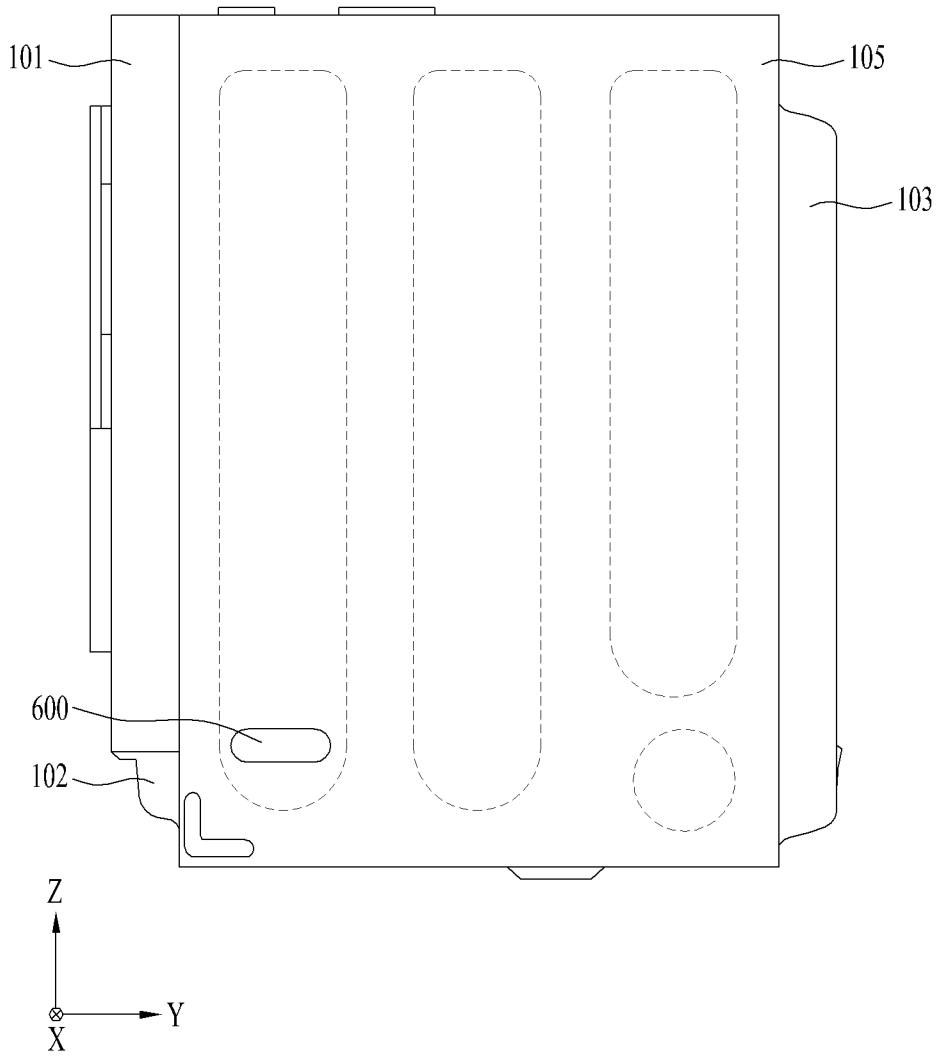
Figure 18:
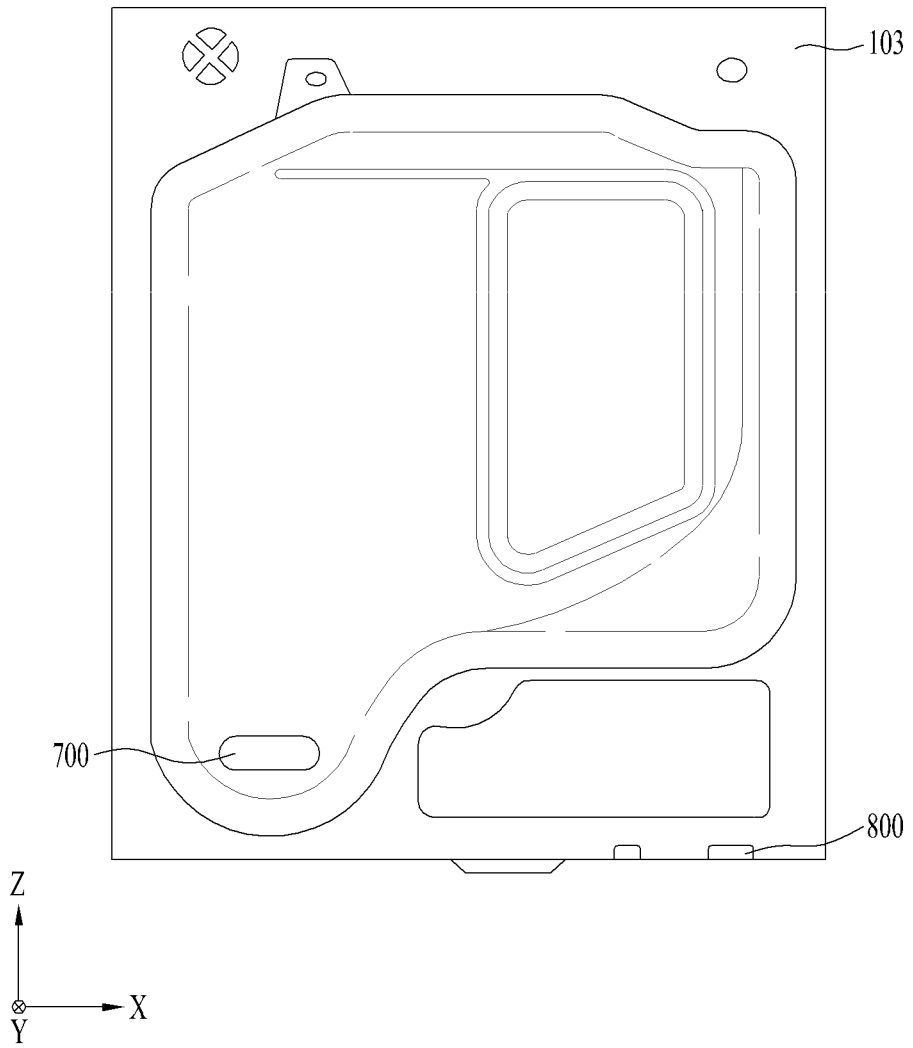

FIGS. 16 to 18 are views illustrating laundry treating apparatuses according to exemplary embodiments of the present disclosure. In detail, FIG. 16 is a side view illustrating a first treating apparatus according to one embodiment of the present disclosure, FIG. 17 is a side view illustrating a first treating apparatus according to another embodiment of the present disclosure, and FIG. 18 is a rear view illustrating a first treating apparatus according to one embodiment of the present disclosure.

Referring to FIGS. 16 and 17, the first treating apparatus 10 may be provided to include a first handle 600 bent to be inserted into the first side panel 105 and provided to allow a user to lift the first treating apparatus 10.

In the exemplary embodiments, the first handle 600 may be formed to be higher than the lowest end of the first drum 15 described with reference to FIGS. 3 and 4, and may be formed to be lower than the uppermost end of the first drum 15. Unlike this case, the first handle 600 may be formed to be lower than the lowest end of the first drum 15 described with reference to FIGS. 3 and 4.

Referring to FIG. 18, the first treating apparatus 10 may be provided to include a second handle 700 bent to be inserted into the first rear panel 103 and provided to allow a user to lift the first treating apparatus 10, and a third handle 800 bent to be inserted into the first lower panel forming the lower surface of the first treating apparatus 10 and provided to allow a user to lift the first treating apparatus 10.

In the exemplary embodiments, the second handle 700 may be formed to be lower than the lowest end of the first drum 15 described with reference to FIGS. 3 and 4.

The first handle 600, the second handle 700 and the third handle 800 may be provided inside the first treating apparatus 10 like the first drum 15 and spaced apart from the internal components constituting the first treating apparatus 10.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A method for assembling a laundry treating apparatus having a first treating apparatus and a second treating apparatus, the method comprising:

positioning the second treating apparatus on a surface, the second treating apparatus including a second front panel, a second rear panel, second side panels, and a second drum, the second drum being (i) located between the second front panel and the second rear panel, (ii) configured to rotate, and (iii) configured to receive laundry;

after positioning the second treating apparatus on the surface and prior to positioning the first treating apparatus on the second treating apparatus, attaching a guide panel to the second treating apparatus;

positioning the first treating apparatus on the second treating apparatus, the first treating apparatus including a first front panel, a first rear panel, first side panels, and a first drum, wherein the first front panel, the first rear panel, and the first side panels are disposed to correspond to the second front panel, the second rear panel, and the second side panels, respectively, the first drum being (i) located between the first front panel and the first rear panel, (ii) configured to rotate, and (iii) configured to receive laundry;

after positioning the first treating apparatus on the second treating apparatus, detaching the guide panel from the second treating apparatus;

coupling the first treating apparatus with the second front panel; and coupling a control panel to a panel seating portion that is defined between a lower surface of the first front panel and an upper surface of the second front panel, wherein the guide panel includes:

a guide panel body detachably located at the panel seating portion, and a roller located at the guide panel body and configured to, based on the first treating apparatus being positioned on the second treating apparatus, contact the lower surface of the first treating apparatus and roll relative to the lower surface of the first treating apparatus, wherein the guide panel is configured to, based on the guide panel being attached to the second treating apparatus, be attached to the panel seating portion that is defined between the lower surface of the first front panel and the upper surface of the second front panel, and wherein the guide panel is configured to, based on the guide panel being detached from the second treating apparatus, be detached from the panel seating portion.

2. The method of claim 1, wherein the second treating apparatus further includes a first frame that is located at a rear surface of the second front panel and coupled to the second side panel, wherein the second front panel includes an upper fastening unit extending from the upper surface of the second front panel, and wherein the upper fastening unit is coupled to the first frame and the first side panel.

3. The method of claim 1, further comprising:

prior to positioning the first treating apparatus on the second treating apparatus, coupling a rear bracket to the second rear panel; and after coupling the first treating apparatus with the second treating apparatus, coupling the rear bracket to the first rear panel.

* * * * *